US006087813A

United States Patent [19]

Tobita

[11] Patent Number: 6,087,813

[45] Date of Patent: Jul. 11, 2000

[54] INTERNAL VOLTAGE GENERATION CIRCUIT CAPABLE OF STABLY GENERATING INTERNAL VOLTAGE WITH LOW POWER CONSUMPTION

[75] Inventor: Youichi Tobita, Hyogo, Japan

[73] Assignee: Mitsubishi Denki Kabushiki Kaisha, Tokyo, Japan

[21] Appl. No.: 09/317,152

[22] Filed: May 24, 1999

[30] Foreign Application Priority Data

Nov. 19, 1998 [JP] Japan ..... 10-329187

[51] Int. Cl.[7] ..... G05F 1/40; G05F 1/44

[52] U.S. Cl. ..... 323/280; 323/284

[58] Field of Search ..... 323/274, 275, 323/280, 281, 282, 284, 266

[56] References Cited

U.S. PATENT DOCUMENTS

| | | | |
|---|---|---|---|
| 5,371,705 | 12/1994 | Nakayama et al. | 365/189.09 |
| 5,399,960 | 3/1995 | Gross | 323/313 |
| 5,557,193 | 9/1996 | Kajimoto | 323/282 |
| 5,644,215 | 7/1997 | Casper | 323/274 |
| 5,831,419 | 11/1998 | Casper | 323/274 |
| 5,942,933 | 8/1999 | Yang | 327/530 |
| 5,959,444 | 9/1999 | Casper | 323/313 |

FOREIGN PATENT DOCUMENTS

| | | | |
|---|---|---|---|
| 2-244488 | 9/1990 | Japan | G11C 11/413 |
| 4-104517 | 4/1992 | Japan | H03K 19/086 |
| 5-303438 | 11/1993 | Japan | G05F 3/24 |

*Primary Examiner*—Shawn Riley
*Assistant Examiner*—Bao Q. Vu
*Attorney, Agent, or Firm*—McDermott, Will & Emery

[57] ABSTRACT

A gate voltage of output driving MOS transistor is adjusted through a negative feedback circuit. The negative feedback circuit suppresses variations in gate voltage of the output MOS transistor by the feedback loop. A gate length of the output driving MOS transistor is set substantially equal to a gate length of a transistor included in the negative feedback circuit. The power supply voltage dependency of the output voltage is canceled out. The output voltage is represented by the difference between threshold voltage of a biasing transistor in the negative feedback circuit and the threshold voltage of the output driving MOS transistor. Output voltage is stably generated at a fixed level without being influenced by operation environment and fluctuation in manufacturing parameters.

20 Claims, 10 Drawing Sheets

INTERNAL VOLTAGE GENERATION CIRCUIT CAPABLE OF STABLY GENERATING INTERNAL VOLTAGE WITH LOW POWER CONSUMPTION

BACKGROUND OF THE INVENTION

1. Field of the Invention

The present invention relates to an internal voltage generation circuit, and particularly to an internal voltage generation circuit capable of generating a voltage at a desired level regardless of the operation environment. More particularly, the present invention relates to an internal power supply circuit with reduced power consumption in a standby state for a semiconductor integrated circuit employed in portable equipment.

2. Description of the Background Art

In portable equipment, various semiconductor integrated circuit devices are used. Static random access memories (SRAMs) are widely used as memory devices in such portable equipment. As the SRAM consumes a low power supply current generally equal to or less than 1 SEA in the standby state, battery driving which is necessary character for portable equipment, can be readily realized. High densification and large scale integration have been progressed to implement an SRAM with high performance and reduced cost. With the high densification/large scale integration progressed, however, a transistor element is miniaturized and breakdown voltage thereof lowers. To prevent dielectric breakdown caused by the reduced breakdown voltage, power supply voltage must be lowered. In a practical system where semiconductor integrated circuit devices are used, however, a wide variety of components are employed and the power supply is generally provided common to all the components. Therefore, it is difficult to alter the power supply voltage, considering the requirement only for the SRAM. Thus, there is a need for a power supply circuit generating a power supply voltage at a lower level in the SRAM without changing a level of the power supply voltage supplied from a source external to the SRAM.

FIG. 21 shows an example of a structure of a conventional internal power supply circuit. In FIG. 21, an SRAM 1 includes a load circuit 5 having peripheral circuitry and a memory array, and an internal power supply circuit 10 supplying an operating power supply voltage to load circuit 5. Load circuit 5 operates receiving a power supply voltage Vo from internal power supply circuit 10 as one operating power supply voltage Vcco. Load circuit 5 also uses ground voltage on a ground node 6 as another operating power supply voltage. A battery 9 supplies power supply voltage to the SRAM.

Internal power supply circuit 10 includes a reference voltage generation circuit 2 generating a reference voltage Vref at a fixed level independent of the power supply voltage (hereinafter referred to as an external power supply voltage) supplied from a source external to SRAM 1, a differential amplifying circuit 3 comparing power supply voltage Vo on an internal power supply line 8 and reference voltage Vref and supplying an output signal according to the result of the comparison, and a current drive transistor 4 connected between a power supply node 7 and internal power supply line 8 and having its conductance controlled by the output signal from differential amplifying circuit 3. Battery 9 applies the voltage on power supply node 7. Current drive transistor 4 is constituted of a p channel MOS (insulated gate type field effect) transistor.

In operation, differential amplifying circuit 3 supplies as an output a signal thereof according to the difference between power supply voltage Vo on internal power supply line 8 and reference voltage Vref. When the level of power supply voltage Vo is higher than that of reference voltage Vref, differential amplifying circuit 3 supplies an output signal at an H (logical high) level, turning current drive transistor 4 to an off-state. Conversely, if the level of power supply voltage Vo is lower than the level of reference voltage Vref, differential amplifying circuit 3 supplies an output signal at a low level according to the difference, hence conductance of the current drive transistor increases and current flows from power supply node 7 to internal power supply line 8, whereby the level of power supply voltage Vo is raised. Thus internal power supply circuit 10 maintains the level of power supply voltage Vo on internal power supply line 8 at the level of reference voltage Vref.

In internal power supply circuit 10, power supply voltage Vo is not generated directly through differential amplifying circuit 3 but through current drive transistor 4 according to the output signal from differential amplifying circuit 3. In other words, current drive transistor 4 acts as a buffer driving internal power supply line 8 according to the output signal of differential amplifying circuit 3, and equivalently increases the current drivability of differential amplifying circuit 3. Differential amplifying circuit 3 and current drive transistor 4 have such current drivability as to prevent the level of power supply voltage Vo from being lowered, even when load circuit 5 operates and consumes power supply current of about a few tens mA.

In the internal power supply circuit shown in FIG. 21, through the adjustment of characteristic values of elements included in reference voltage generation circuit 2 with laser trimming or the like, precise setting of the level of reference voltage Vref, or the level of power supply voltage Vo can be achieved. As well known, however, in differential amplifying circuit 3, current is supplied from a current mirror circuit to a comparison stage, and the voltage level and response speed of the output signal are determined by the current amount. Therefore, in differential amplifying circuit 3, a relatively large power supply current (current flowing from the power supply node to the ground node of differential amplifying circuit 3) of about a few $\mu$A flows, thereby causing a problem of large current consumption in the standby state. Unlike a DRAM (Dynamic Random Access Memory), in the SRAM, at the activation of a chip select signal or a chip enable signal, a row and a column are simultaneously selected inside. If differential amplifying circuit 3 is maintained in an inactive state during the standby, the activation of differential amplifying circuit 3 is delayed at the start of an active cycle (memory cell selection operation cycle), and decrease in operating power supply voltage Vcco of load circuit 5 caused by a leakage current in a standby cycle cannot be compensated for, whereby a stable operation cannot be secured. Therefore the operation of differential amplifying circuit 3 cannot be stopped simply in the standby.

FIG. 22 represents another structure of the conventional internal power supply circuit. In FIG. 22, an internal power supply circuit 10 includes a high resistance element 11 connected between a power supply node 7 and a node 14, and n channel MOS transistors 12-1~12-6 connected in series between node 14 and a ground node 6. These n channel MOS transistors 12-1~12-6 each have a gate and a drain connected together.

Internal power supply circuit 10 further includes a current drive transistor 13 constituted of an n channel MOS transistor causing a current flow from power supply node 7 to an output node 15 according to a voltage on node 14 to generate an output voltage Vo. The resistance value of high resistance element 11 is set sufficiently higher than a channel resistance (on resistance) of MOS transistors 12-1~12-6. Therefore, these MOS transistors 12-1~12-6 each operate in a diode mode and cause a voltage drop of threshold voltage VTN. Thus, voltage V14 at node 14 is represented by the following equation.

$$V14=6\cdot VTN$$

MOS transistor 13 operates in a source follower mode because the level of its gate voltage is lower than voltage level on a drain node.

Therefore the level of output voltage Vo on output node 15 is lower than the level of voltage V14 on node 14 by threshold voltage VTN of MOS transistor 13. Thus, output voltage Vo is represented by the following equation.

$$Vo=V15=V14-VTN=6-VTN-VTN=5\cdot VTN$$

When threshold voltage VTN is 0.7 V, output voltage Vo is 3.5 V.

In the structure of internal power supply circuit 10 shown in FIG. 22, the power supply current is determined by the resistance value of resistance element 11. The resistance value of resistance element 11 can be increased substantially without limitation (the power supply current can be reduced to a current value of the order of pA as it is used only for compensating for leakage current at PN junctions of MOS transistors 12-1~12-6). Thus the power supply current can be easily set equal to or less than 1 $\mu$A, which is a requirement for standby leakage current in the SRAM, whereby reduced power consumption in the standby state is achieved.

Threshold voltage VTN, however, has temperature dependency of about 2 mV/° C. and varies by 0.1 to 0.2 V chip by chip due to fluctuation of manufacturing parameters. As output voltage Vo is given by an integer multiple of the threshold voltage VTN, temperature dependency and variations are also amplified. In the structure of FIG. 22, the variation is about 1 V, and in practice, output voltage Vo cannot be generated at a correct level.

The problem of the internal power supply circuit as described above is also encountered in a circuit generating an internal voltage at a predetermined level such as reference voltage.

SUMMARY OF THE INVENTION

An object of the present invention is to provide an internal voltage generation circuit capable of stably generating an internal voltage at a desired level with a low power consumption.

Another object of the present invention is to provide an internal voltage generation circuit capable of stably generating an internal voltage at a desired level regardless of an operation environment and the fluctuation of manufacturing parameters.

A further object of the present invention is to provide an internal power supply circuit with a low power consumption, particularly suitable for the SRAM.

In brief, the present invention suppresses, through a negative feedback, variations in bias voltage of a biasing transistor which sets gate voltage of an output transistor generating an internal voltage in a source follower mode.

In addition, the present invention suppresses variations in threshold voltage by trimming through a programming element to achieve a desired voltage level.

With the biasing transistor and the output transistor, the output voltage is generated at a level represented by a difference between threshold voltages of these transistors, and temperature dependency of the threshold voltages and so on are canceled. In addition, even if a voltage on a constant voltage node such as a power supply node fluctuates, variation of the gate voltage of the output transistor is suppressed through the feedback circuit. Therefore an internal voltage can be stably generated at a desired level even when operation environment varies.

In addition, output voltage can be maintained at a fixed level by adjustment of gate voltage of the output transistor through feedback of output voltage.

In addition, power consumption in the standby is reduced because the output transistor is a voltage driven element and requires no driving current.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Structure of Basic Circuit]

Figure 1:
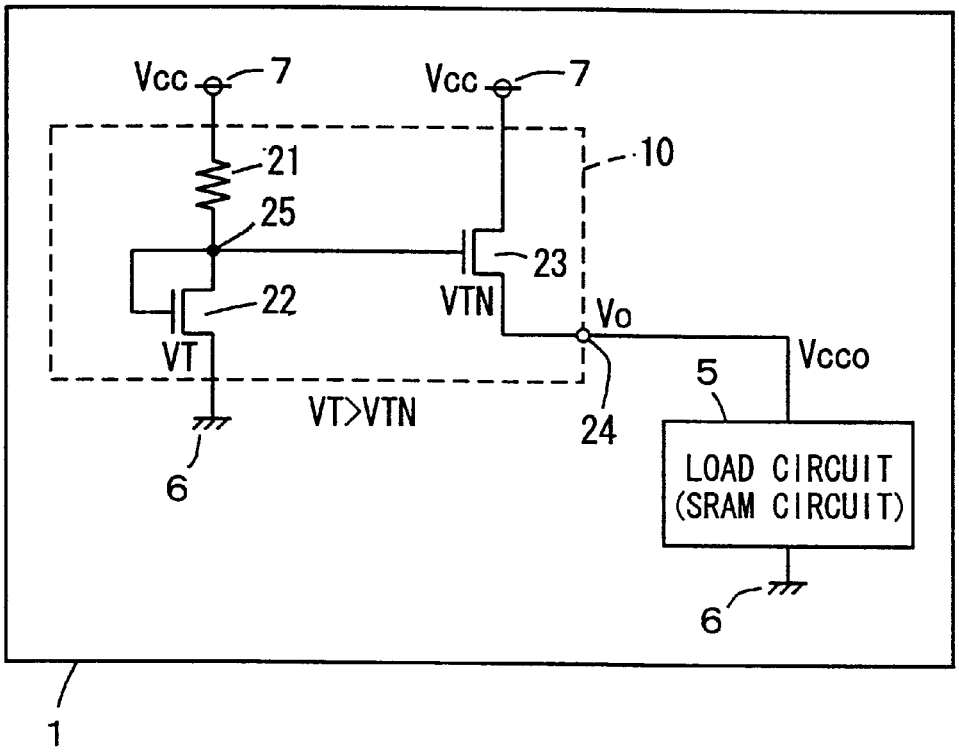
FIG. 1 represents a structure of a basic internal power supply circuit of the present invention.

FIG. 1 represents a structure of a basic internal power supply circuit according to the present invention. The inventor has contrived the circuit structure shown in FIG. 1 in order to solve the problem of the conventional internal power supply circuit, that is, the temperature dependency of the output voltage.

Similar to the conventional circuit, an SRAM 1 shown in FIG. 1 includes a load circuit 5 and an internal power supply circuit 10 supplying an operating power supply voltage to load circuit 5. Load circuit 5 is an SRAM circuit including a memory cell array and peripheral circuitry such as an address decoder, an I/O (input/output) control circuit.

Internal power supply circuit 10 includes a high resistance element 21 connected between a power supply node 7 and a node 25, an n channel MOS transistor 22 connected between node 25 and a ground node 6 and having a gate and a drain connected to node 25, and an n channel MOS transistor 23 supplying current from power supply node 7 to an output node 24 according to a voltage level on node 25 to generate output voltage Vo. MOS transistor 22 has threshold voltage VT, whereas MOS transistor 23 has threshold voltage VTN. The level of threshold voltage VT is set sufficiently higher than the level of threshold voltage VTN.

The resistance value of resistance element 21 is sufficiently higher than a channel resistance (on resistance) of MOS transistor 22. Therefore, MOS transistor 22 operates in the diode mode and the voltage level of node 25 is at the level of threshold voltage VT of MOS transistor 22.

MOS transistor 23 in the output stage is rendered non-conductive when the gate-source voltage drops to or below the level of threshold voltage VTN. When the gate-source voltage rises above the level of threshold voltage VTN, MOS transistor 23 is rendered conductive to supply current from power supply node 7 to output node 24, thereby pulling up the level of output voltage Vo. Due to the operation of MOS transistor 23, output voltage Vo is set to a level represented by the following equation.

$$Vo=VT-VTN$$

Threshold voltage VTN of MOS transistor 23 is substantially equal to that of a MOS transistor included in SRAM circuit 5 and is about 0.7 V. On the other hand threshold voltage VT of MOS transistor 22 is set sufficiently high, for example at the level of 3.7 V. Under this condition, output voltage Vo is represented by the following equation.

$$Vo=VT-VTN=3.7-0.7=3.0 \quad (V)$$

Therefore, SRAM circuit 5 can receive a voltage at the level of about 3.0 V as operating power supply voltage Vcco. The level of operating power supply voltage Vcco is equal to the level of output voltage Vo of internal power supply circuit 10. Output voltage Vo is represented as the difference between threshold voltages VT and VTN. Thus, the temperature dependency and variation of threshold voltages VT and VTN caused in manufacturing are cancelled (here, the variations of the threshold voltages of MOS transistors 22 and 23 caused in manufacturing are approximately equal because they are arranged proximate each other). Therefore, the level of output voltage Vo is not affected by the temperature dependency and variations in threshold voltages attributable to the manufacturing process, and attains an approximately constant level.

The threshold voltage of MOS transistor 22 is adjusted by forming a thick gate insulation film, for example, of 1000 A to 2000 A. A gate insulation film of MOS transistor 23 is about 100 A as in the MOS transistor which is a component of SRAM circuit 5. Therefore, different threshold voltages can be set. In addition, if necessary, fine adjustment of threshold voltage VT of MOS transistor 22 can be made by ion implantation of an impurity into a surface of a substrate region directly below a gate electrode. High resistance element 21 is constituted of refractory metal such as polysilicon, impurity diffusion resistance or a resistance connected MOS transistor (insulated gate field effect transistor).

In the structure shown in FIG. 1, power supply current can be made equal to or less than 1 $\mu$A in the standby state, by setting a resistance value of resistance element 21 sufficiently high, thereby satisfying the specification value of the power supply current in standby required for the SRAM. It has been found, however, by the investigation of the inventor that in the structure shown in FIG. 1, output voltage Vo, that is, operating power supply voltage Vcco is dependent on voltage Vcc on power supply node 7 and output voltage Vo (Vcco) fluctuates with the change in operation environment.

Figure 2:
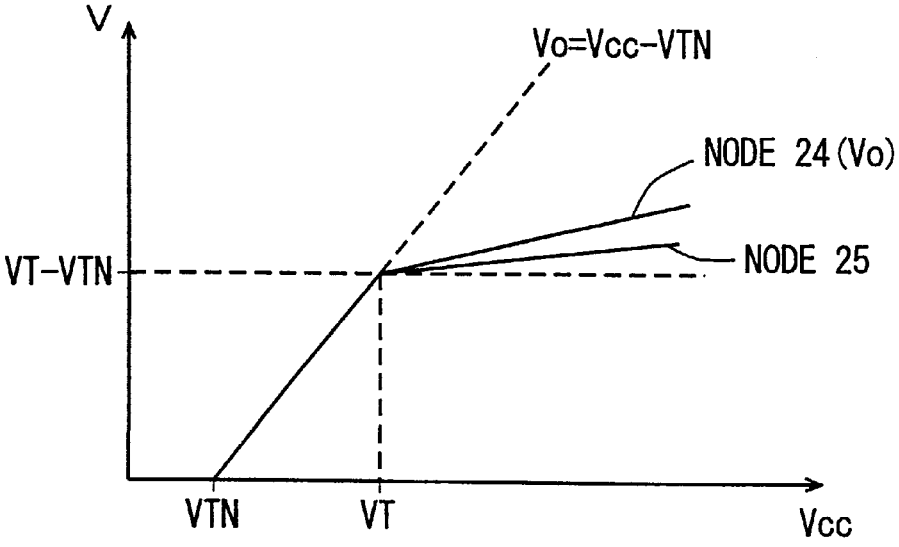
FIG. 2 represents operation characteristics of the internal power supply circuit shown in FIG. 1.

FIG. 2 shows dependency of the voltages on the output node and the internal node of the internal power supply circuit shown in FIG. 1 on the power supply voltage. In FIG. 2, the abscissa represents voltage Vcc on power supply node 7 and the ordinate represents voltage.

In the structure of the internal power supply circuit shown in FIG. 1, the level of output voltage Vo on output node 24 changes according to the level of external power supply voltage Vcc until it reaches the level of voltage VT−VTN. When MOS transistor 23 is rendered conductive while MOS transistor 22 remains non-conductive (VT>VTN), the level of voltage on node 25 rises according to external power supply voltage Vcc. In accordance with the increase in level of the voltage on node 25, MOS transistor 23 pulls up the level of output voltage Vo on output node 24. When the level of external power supply voltage Vcc reaches the level of threshold voltage VT, MOS transistor 22 is rendered conductive and operates in the diode mode thereby maintaining the level of the voltage on node 25 at a fixed level. Therefore, even if the level of external power supply voltage Vcc exceeds the level of threshold voltage VT, output voltage Vo should be maintained at a level of voltage VT−VTN.

In practice, however, the level of output voltage Vo rises according to the rise in the level of external power supply voltage Vcc as shown by a solid line in FIG. 2. This phenomena is caused by two factors, that is, a circuit-related factor and a device-related factor described below.

(1) Circuit-Related Factor

In FIG. 1, the voltage on node 25 is clamped approximately at the level of threshold voltage VT by MOS transistor 22. As external power supply voltage Vcc, however, current flowing through resistance element 21 increases (because a voltage drop across resistance element 21 must be increased to maintain the voltage on node 25 at a fixed level). When the current increases, parasitic resistance (channel resistance) of MOS transistor 22 works and causes a voltage drop. As a certain magnitude of voltage is added to the drain voltage of MOS transistor 22 because of this parasitic resistance, the level of the voltage on node 25 rises. The increase in level of the voltage on node 25 is transmitted to output voltage Vo via MOS transistor 23 operating in the source follower mode, thereby raising the level of output voltage Vo.

(2) Device-Related Factor

With the rise in external power supply voltage Vcc, drain-source voltage of output MOS transistor 23 rises. Under this condition, a depletion layer expands in a drain portion of output MOS transistor 23, thereby reducing an effective channel length. As the current drivability of output MOS transistor 23 is represented by the ratio of channel width to channel length, when the effective channel length is shortened, the current drivability of output MOS transistor 23 increases, thereby raising the level of output voltage Vo. The expansion of depletion layer in the drain portion is caused by a more deepened reverse bias state of a PN junction in the drain portion. Particularly in an output driving transistors such as output MOS transistor 23, gate length of the transistor is shortened to a minimum value at a design level (to make the ratio of gate width to gate length as high as possible) for a larger current drivability. Therefore the effect of the reduced effective channel length caused by the expansion of the depletion layer is more significant. In addition, if short channel effect is caused, the threshold voltage of output MOS transistor 23 is also reduced and therefore the level of output voltage Vo is raised. Due to these factors, the level of output voltage Vo from output node 24 becomes higher than the level of voltage on node 25.

When the level of internal power supply voltage Vcco rises with the increase in level of external power supply voltage Vcc, the MOS transistor in SRAM circuit 5 operates faster and then the timing of operation of internal circuits becomes different from the designed timing whereby the stable operation cannot be secured.

In practice, the SRAM is applicable regardless of the existence of power supply voltage dependency in some cases. External power supply voltage dependency is desirably to be minimized, however, in order to assure a stable operation of the SRAM circuit regardless of the variation in external power supply voltage Vcc. Even if biasing MOS transistor 22 in FIG. 1 is replaced with a p channel MOS transistor, the same problem remains. Hereinafter, an internal voltage generation circuit for solving the problem of the internal power supply circuit shown in FIG. 1 will be described.

[First Embodiment]

Figure 3:
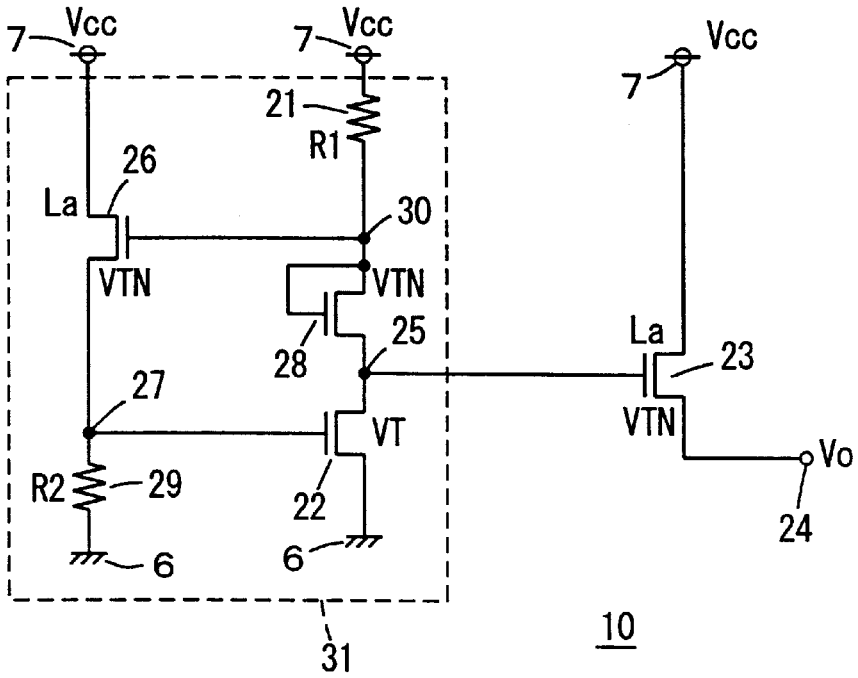
FIG. 3 represents a structure of an internal power supply circuit according to a first embodiment of the present invention.

FIG. 3 represents a structure of an internal power supply circuit according to a first embodiment of the present invention. In FIG. 3, an internal power supply circuit 10 includes a resistance element 21 connected between a power supply node 7 and a node 30 and having a resistance value R1, an n channel MOS transistor 26 connected between power supply node 7 and a node 27 and having a gate connected to node 30, an n channel MOS transistor 28 connected between node 30 and a node 25 and having a gate connected to node 30, an n channel MOS transistor 22 connected between node 25 and a ground node 6 and having a gate connected to node 27, and a resistance element 29 connected between node 27 and ground node 6 and having a resistance value R2. Resistance elements 21 and 29 and MOS transistors 22, 26 and 28 form a negative feedback circuit 31 with biasing MOS transistor 22 being a center. Resistance value R1 of resistance element 21 is set at a value sufficiently higher than a channel resistance (on resistance) of MOS transistors 28 and 22, and resistance R2 of resistance element 29 is set at a value sufficiently higher than a channel resistance (on resistance) of MOS transistor 26.

Internal power supply circuit 10 further includes an n channel MOS transistor 23 connected between power supply node 7 and an output node 24 and having a gate receiving the voltage from node 25. Output MOS transistor 23 has threshold voltage VTN. Now, an operation of internal power supply circuit 10 shown in FIG. 3 will be described.

Resistance value R1 of resistance element 21 is set at a value sufficiently higher than the channel resistance of MOS transistor 28 that operates in the diode mode. MOS transistor 22 discharges current of an amount according to the level of the voltage on node 27 to ground node 6, thereby setting the level of the voltage on node 25 at an appropriate level. MOS transistor 26 receives a voltage of a level lower than the level of drain voltage at its gate, has the on resistance sufficiently lower than resistance value R2 of resistance element 29, and operates in the source follower mode. When the level of the voltage on node 30 rises, the raised voltage is transmitted to node 27 by the source follower mode operation of MOS transistor 26. Accordingly, conductance of MOS transistor 22 increases, thereby decreasing the level of the voltage on node 25 (sinking more current flow). Thus, the level of the voltage on node 30 is lowered.

Conversely, when the level of the voltage on node 30 decreases, the level of the voltage on node 27 is lowered by the source follower mode operation of MOS transistor 26, and accordingly, conductance of MOS transistor 22 is reduced (discharge current amount is reduced) and the level of the voltage on node 25 is raised, thereby raising the level of the voltage on node 30 correspondingly. Therefore, by the appropriate selection of the sizes of MOS transistors 28 and 22, the level of the voltage on node 25 can be maintained at a fixed level regardless of the variation in external power supply voltage Vcc. The function of the negative feedback circuit shown in FIG. 3, will be described in detail later.

(1) Device-Related Factor

Generally, the gate length of output MOS transistor 23 is made as short as possible in order to increase the current drivability. When such MOS transistor with a short gate length is employed, output voltage Vo on node 24 depends on power supply voltage as described above even if the power supply voltage dependency of the voltage on node 25, or the gate voltage, is set equal to zero. As output MOS transistor 23 operates in the source follower mode, the gate voltage of output MOS transistor 23 must be lowered in order to suppress the increase in output voltage Vo. Voltage at the level approximately equal to that of drain-source voltage of output MOS transistor 23 (difference between external power supply voltage Vcc and output voltage Vo) is applied between the drain and the source of MOS transistor 26. Therefore, a gate length (channel length) La of MOS transistor 26 and a gate length La of output MOS transistor 23 are set substantially equal to each other. Thus, the source voltage of MOS transistor 26 has dependency on external power supply voltage same as output MOS transistor 23. Though the level of voltage on node 27 is increased due to the external power supply voltage dependency of MOS transistor 26, raised voltage on node 27 is cancelled by the negative feedback formed by MOS transistors 22 and 26 (increase in conductance of MOS transistor 22), whereby the level of the voltage on node 25 is lowered.

In other words, when the level of output voltage Vo rises because of the external power supply voltage dependency of the drain-source voltage of output MOS transistor 23, MOS transistor 26 having the similar external power supply voltage dependency causes the increase in level of the voltage on node 27, the increase in conductance of MOS transistor 22, and the drop of the voltage on node 25. Thus, conductance of output MOS transistor 23 is reduced, amount of current flowing from power supply node 7 to output node 24 is decreased and rise in output voltage Vo is suppressed. In other words, the transmission of reduced gate voltage to output node 24 by the source follower mode operation of output MOS transistor 23 suppresses the rise of output voltage Vo.

Figure 4:
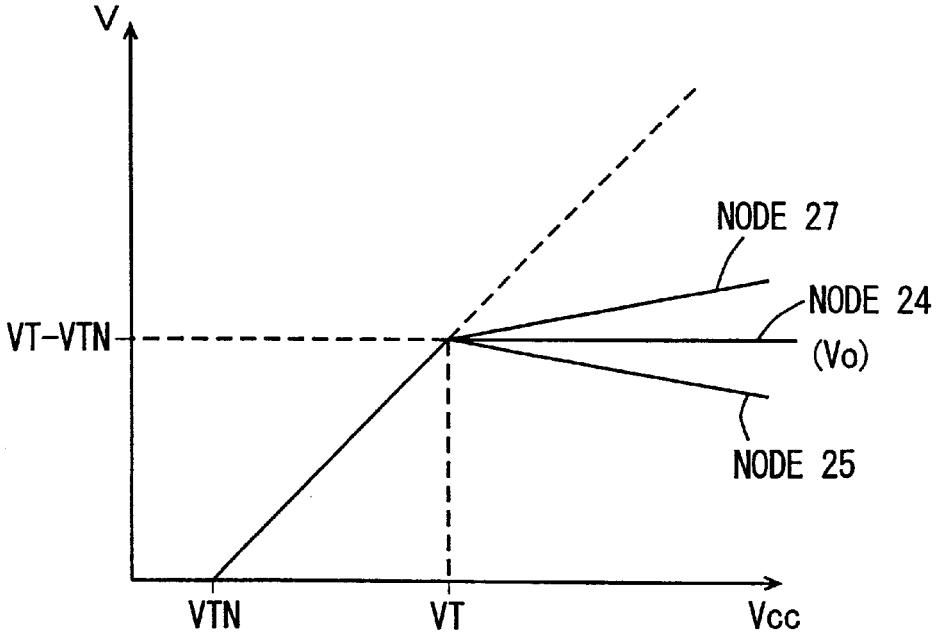
FIG. 4 represents operation characteristics of the internal power supply circuit shown in FIG. 3.

As can be seen from FIG. 4, because of the increase in level of external power supply voltage Vcc followed by the increase in level of the voltage on node 27 and by the decrease in level of the voltage on node 25, output voltage Vo on node 24 is maintained at a substantially constant value and the external power supply voltage dependency of output voltage Vo is set substantially equal to zero.

By adjusting the sizes of MOS transistors 22 and 28 such that the change in current amount caused by change in conductance of MOS transistor 22 does not influence the amount of voltage drop caused by the channel resistance of MOS transistor 28 (in other words, by making the size (the ratio of channel width to channel length) of MOS transistor 22 sufficiently larger than that of MOS transistor 28), dependency of output voltage Vo on external power supply voltage Vcc can be cancelled with the voltage on node 25.

In the stable operation, the level of the voltage on node 27 attains the level of threshold voltage VT of MOS transistor 22 because of the current supplying capability of MOS transistor 22 set high enough. Because of the source follower mode operation of MOS transistor 26, the level of the voltage on node 30 attains a level higher than the level of the voltage VT on node 27 by threshold voltage VTN 26 of MOS transistor 26. Hence, voltage 30 of node 30 is represented by the following equation.

$$V30=VT+VTN26$$

On the other hand, the level of the voltage on node 25 is made lower than the level of voltage V30 on node 30 by threshold voltage VTN28 of MOS transistor 28 because of the effect of diode-connected MOS transistor 28. Therefore, voltage V25 on node 25 is represented by the following equation.

$$V25=V30-VTN28=VT+VTN26-VTN28$$

The level of the output voltage Vo on node 24 is at the level lower than the level of the voltage V25 on node 25 by threshold voltage VTN23 of MOS transistor 23, and, therefore, is represented by the following equation.

$$Vo=V25-VTN23=VT+VTN26-VTN28-VTN23$$

Provided that VTN26 =VTN28 =VTN23 =VTN in the above equation, output voltage Vo can be represented by the following equation.

$$Vo=VT-VTN$$

Thus, with the use of the internal power supply circuit shown in FIG. 3, the power supply current of negative feedback circuit 31 is made extremely low during the standby because of high resistance elements 21 and 29, and about 1 $\mu$A current value which is appropriate for the SRAM can be realized. In addition, the dependency of output voltage Vo on external power supply voltage Vcc can be eliminated by negative feedback circuit 31. As output voltage Vo is represented as the difference between the threshold voltage of MOS transistor 22 and the threshold voltage of output MOS transistor 23, effect of the threshold voltages is cancelled. Therefore, output voltage Vo can be stably generated at a fixed level regardless of the change in operation environment.

[Second Embodiment]

Figure 5:
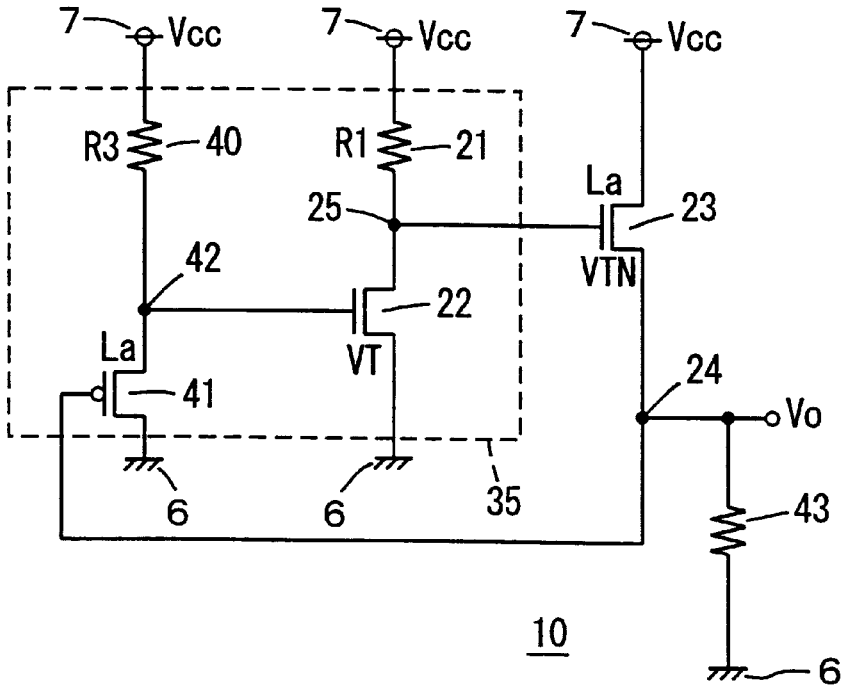
FIG. 5 represents a structure of an internal power supply circuit according to a second embodiment of the present invention.

FIG. 5 represents a structure of an internal power supply circuit according to a second embodiment of the present invention. In FIG. 5, an internal power supply circuit 10 includes an output MOS transistor 23 constituted of an n channel MOS transistor supplying current from an external power supply node 7 to an output node 24 to generate output voltage Vo, and a biasing circuit 35 maintaining a gate voltage of output MOS transistor 23 at a fixed level. Biasing circuit 35 includes a high resistance element 40 connected between power supply node 7 and a node 42 and having resistance value R3, a p channel MOS transistor 41 connected between node 42 and a ground node 6 and having a gate receiving output voltage Vo from output node 24, a resistance element 21 connected between power supply node 7 and a node 25 and having resistance value R1, and an n channel MOS transistor (biasing transistor) 22 connected between node 25 and ground node 6. Resistance values R3 and R1 of resistance elements 40 and 21 are respectively set at values sufficiently higher than the channel resistances of MOS transistors 41 and 22. MOS transistor 41 having threshold voltage VTP41, operates in the source follower mode and sets the voltage V42 on node 42 at a level represented by the following equation.

$$V42=|VTP41|+Vo$$

As the level of the voltage on node 25 rises, conductance of output MOS transistor 23 increases, and the level of the output voltage Vo from output node 24 rises and accordingly the level of the voltage on node 42 rises. According to the raised voltage on node 42, conductance of MOS transistor 22 increases thereby lowering the level of the voltage on node 25. With the fall of the voltage on node 25, the level of output voltage Vo from output node 24 reduces due to the source follower operation of MOS transistor 23, and accordingly the level of the voltage on node 42 falls via the source follower mode operation of MOS transistor 41. Then, conductance of MOS transistor 22 is decreased and the level of the voltage on node 25 is raised.

Thus, through the feedback path from output node 24 through MOS transistors 41 and 22, the voltage on node 25 is maintained at a substantially constant level. Resistance value R1 of resistance element 21 is set at a value sufficiently higher than on-resistance of MOS transistor 22. Therefore, at the stable operation, gate voltage of MOS transistor 22 or the voltage on node 42 is maintained at the level of threshold voltage VT of MOS transistor 22. Thus, output voltage Vo is represented by the following equation.

$$Vo=VT-|VTP41|$$

Output voltage Vo is the difference between threshold voltage VT and the absolute value |VTP41 | of threshold voltage of MOS transistor 41. Therefore the temperature dependency and the variation in voltage VT and |VTP41 | caused in manufacturing are cancelled and a stable-generation of output voltage Vo at a desired level is allowed.

In addition, in the circuit shown in FIG. 5, a negative feedback circuit is configured including output node 24. Even if the level of external power supply voltage Vcc rises and output voltage Vo from output node 24 increases, the level of the voltage on node 25 is decreased by the function of MOS transistors 41 and 22 as described above, and the level of the output voltage Vo is decreased by the source follower operation of MOS transistor 23. Therefore, at the rise of external power supply voltage Vcc, negative feedback is applied through the negative feedback loop in a direction to decrease output voltage Vo, and output voltage Vo is maintained at a fixed level regardless of the variation in external power supply voltage Vcc.

In addition, in the operation of the load (SRAM circuit) with a consumption of large current followed by a decrease in output voltage Vo, level of the voltage on node 42 lowers and the level of the voltage on node 25 rises. Therefore, output voltage Vo can be maintained at a constant level independent of the change in load current, and output voltage Vo at a fixed level can be supplied to the SRAM circuit even at fluctuation in output load, whereby the stable operation of the SRAM circuit is allowed.

In MOS transistor 23, the gate length is reduced substantially to a minimum value at a design level to increase the current drivability. In this case, as in the first embodiment described above, the effective channel length of output MOS transistor 23 is shortened, hence output voltage Vo tends to increase. As the gate length of MOS transistor 41 is substantially the same with the gate length of output MOS transistor 23, the effect can be cancelled. By effectively causing short channel effect of MOS transistor 41 to increase current amount by this short channel effect at the rise of output voltage Vo for causing a voltage drop across channel resistance component of MOS transistor 41, the level of the voltage on node 42 is raised. Then, the level of the voltage on node 25 is lowered through MOS transistor 22 with increased conductance, reducing the conductance of MOS transistor 23, thereby suppressing the increase in output voltage Vo.

In addition, a high resistance element 43 is connected between output node 24 and ground node 6. High resistance element 43 acts as a pull down resistance and pulls down the level of output voltage Vo when MOS transistor 23 is rendered non-conductive at the rise of output voltage Vo. Thus, output voltage Vo is prevented from being maintained unnecessarily at a higher level than the predetermined level for a long period. Therefore, a pull down resistance element such as element 43 may also be provided to output node 24 in the structure shown in FIG. 3.

[Modification]

Figure 6:
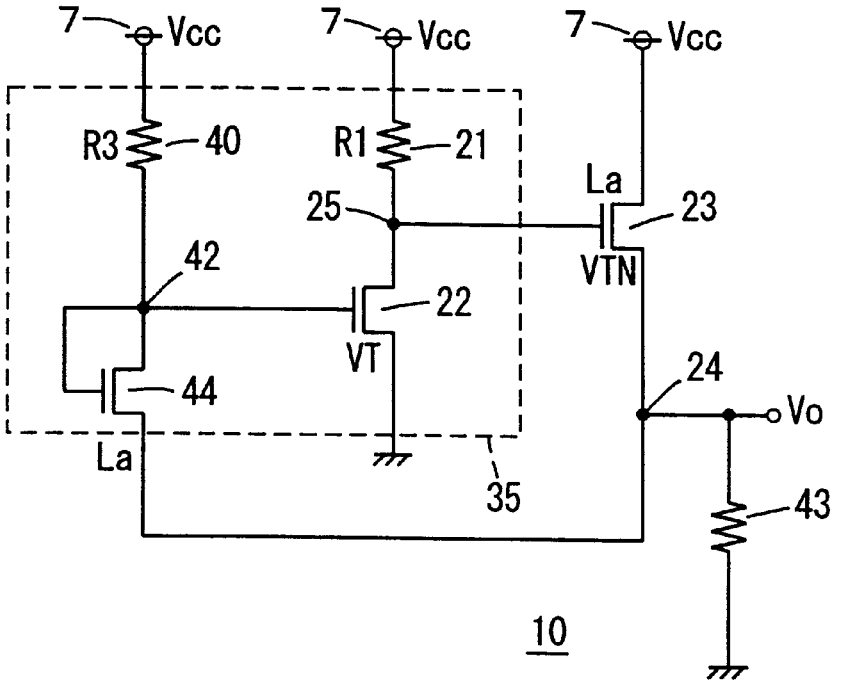
FIG. 6 represents a structure of a modification of the second embodiment of the present invention.

FIG. 6 represents a structure of a modification of the second embodiment of the present invention. The structure shown in FIG. 6 is different from the structure shown in FIG. 5 in the following points. An n channel MOS transistor 44 having a source coupled to output node 24 is provided to node 42. MOS transistor 44 has a gate connected to node 42. Other parts of the structure is the same with that in FIG. 5 and corresponding components have the same reference numerals allotted.

As resistance value R3 of resistance element 40 is set at a sufficiently higher value than the channel resistance of MOS transistor 44, MOS transistor 44 operates in the diode mode. Therefore, voltage V42 on node 42 is represented by the following equation.

$$V42=Vo+VTN44$$

where VTN 44 indicates threshold voltage of MOS transistor 44. At the rise of voltage on node 25, output voltage Vo rises and the level of the voltage on node 42 increases. Correspondingly, conductance of MOS transistor 22 increases, and the level of the voltage on node 25 drops, thereby suppressing the rise of output voltage Vo. On the other hand, at the drops of output voltage Vo, the level of the voltage on node 42 drops, conductance of MOS transistor 22 decreases and the level of the voltage on node 25 rises, thereby raising the level of output voltage Vo. Hence, the voltage on node 25 is continuously adjusted such that output voltage Vo is maintained at a constant level. Channel resistance of MOS transistor 22 is sufficiently lower than resistance value RI of resistance element 21. Therefore, only a minute current flows through MOS transistor 22, and in the stable operation, the level of the voltage on node 42 is at the level of threshold voltage VT of MOS transistor 22. Therefore, output voltage Vo is represented by the following equation.

$$Vo=VT-VTN44$$

In this case, as output voltage Vo is represented as the difference between threshold voltages of MOS transistors 22 and 44, the temperature dependency and any variation caused in manufacturing can be cancelled.

In addition, the effect of reduction of effective channel length at the rise of power supply voltage Vcc of output MOS transistor 23 can be cancelled by setting the gate length of MOS transistor 44 substantially equal to the gate length of MOS transistor 23. At the rise of output voltage Vo, the amount of current flowing through MOS transistor 44 increases and a voltage drop at node 42 is caused by the channel resistance to raise the level of the voltage on node 42. Thus the conductance of MOS transistor 22 is increased to decrease the level of the voltage on node 25. Therefore, the dependency of output voltage Vo on the power supply voltage can be cancelled and output voltage Vo at a fixed level can be stably generated without being affected by variation in operation environment and manufacturing conditions.

[Third Embodiment]

Figure 7:
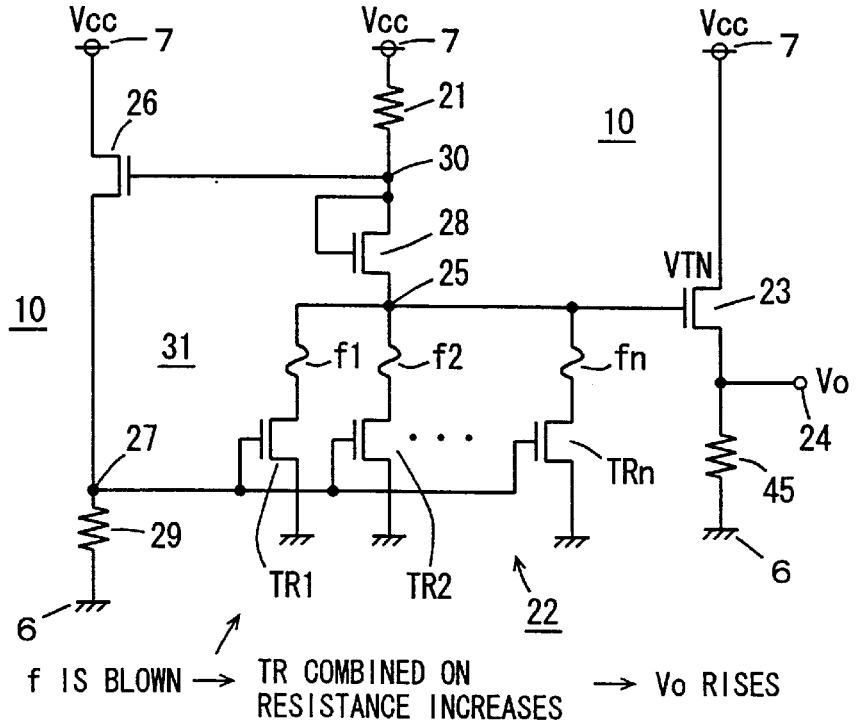
FIG. 7 represents a structure of an internal power supply circuit according to a third embodiment of the present invention.

FIG. 7 represents a structure of an internal power supply circuit 10 according to a third embodiment of the present invention. In internal power supply circuit 10 shown in FIG. 7, biasing MOS transistor 22 for setting the gate voltage of output MOS transistor 23 is replaced with a plurality of trimming elements. Other portions are the same with that of FIG. 3 and corresponding components have the same reference characters allotted.

The plurality of trimming elements include link elements f1~fn with programmable conductive/non-conductive states and n channel MOS transistors TR1~TRn connected in series with link elements f1~fn, respectively. Link elements f1~fn can be blown by laser, for example. Gates of MOS transistors TR1~TRn are commonly connected with node 27.

Output voltage Vo is determined by the difference between threshold voltage VTN of output MOS transistor 23 and threshold voltage of biasing MOS transistor 22. Therefore, when the threshold voltage largely deviates from the predetermined value because of fluctuation in manufacturing parameters or the like, the level of output voltage Vo also changes significantly. MOS transistors TR1~TRn are arranged in proximity with each other and influenced by the variation of threshold voltage to the same extent to have substantially the same threshold voltage. In addition, the channel resistance (on resistance) of these MOS transistors TR1~TRn are considered to be substantially the same. The channel resistances of MOS transistors TR1~TRn are connected in parallel between node 25 and ground node 6. When link elements f1~fn are blown, channel resistances of the MOS transistors are disconnected from node 25. Therefore, by blowing link elements f1~fn, the number of parasitic resistance (channel resistance) connected in parallel to node 25 is reduced, whereby the combined resistance value of channel resistance is increased. At the same time, as the number of transistors driving the current is reduced, contribution of channel resistance is increased.

Thus, when the threshold voltage of biasing MOS transistor 22 is low, the level of the voltage on node 25 can be raised by increasing the resistance value of the combined channel resistances by blowing the appropriate number of link elements f1~fn. The level of output voltage Vo can be thus raised. The selective blow of the channel resistances allows the correction of an error in threshold voltage Vo ranging from about—0.1~0.2 V.

In addition, resistance element 45 connected to output node 24 is a pull-down element. When no load is associated to output node 24 (when the SRAM circuit is in the standby state), if the level of output voltage Vo on output node 24 rises, resistance element 45 causes discharge of output node 24 and drives the level of the voltage to an appropriate level.

Current drivability of each of MOS transistors TR1~TRn is set substantially equal to or greater than current drivability of diode-connected MOS transistor 28. Even when the number of MOS transistors TR1~TRn connected to node 25 changes, discharging of node 25 is possible with a large current drivability and the level of the voltage on node 27 can be correctly maintained substantially the level of threshold voltage VT of these MOS transistors TR1~TRn.

As can be seen from the foregoing, according to the third embodiment of the present invention, as the channel resistance of the biasing MOS transistor for setting the gate voltage of the output MOS transistor can be trimmed, the output voltage can be obtained correctly at a desired level from chip to chip regardless of the variation in threshold voltage of the MOS transistors.

[Fourth Embodiment]

Figure 8:
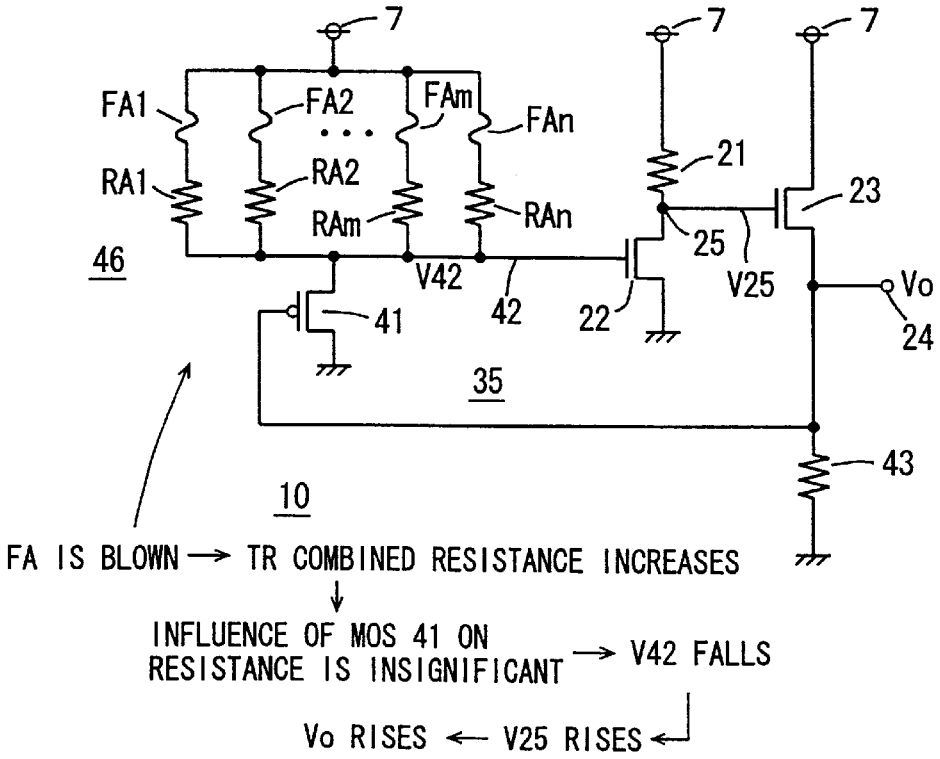
FIG. 8 represents a structure of an internal power supply circuit according to a fourth embodiment of the present invention.

FIG. 8 represents a structure of an internal power supply circuit according to a fourth embodiment of the present invention. The internal power supply circuit shown in FIG. 8 is different from the internal power supply circuit shown in FIG. 5 in that resistance element 40 is replaced with a trimmable resistance element 46 having a trimmable resistance value. Internal power supply circuit 10 shown in FIG. 8 is the same with the internal power supply circuit shown in FIG. 5 in other portions and corresponding components have the same reference characters allotted.

Trimmable resistance element 46 includes link elements FA1~FAn each having one end connected to a power supply node 7 and being programmable to be conductive/non-concductive, and resistance elements RA1~RAn connected between link elements FA1~FAn and a node 42, respectively. Link elements FA1~FAn are constituted, for example, of fuse elements that can be blown by laser.

In the structure of internal power supply circuit 10 shown in FIG. 8, the level of the voltage on node 42 is set by the source follower operation of MOS transistor 41. When the resistance value of trimmable resistance. element 46 is sufficiently high, the effect of the channel resistance of MOS transistor 41 can be ignored approximately, and the voltage on node 42 is given as a sum of output voltage Vo and the absolute value of the threshold voltage of MOS transistor 41. On the other hand, when the resistance value of trimmable resistance element 46 becomes low, the effect of the channel resistance of MOS transistor 41 cannot be ignored, and the level of the voltage on node 42 is given as a sum of the absolute value of the threshold voltage of MOS transistor 41 and the amount of voltage drop across the channel resistance.

Therefore, decrease in the resistance value of trimmable resistance element 46 allows rise of the voltage level on node 42. When the voltage level on node 42 rises, conductance of MOS transistor 22 is reduced and the amount of voltage drop across the channel resistance increases, thereby lowering the voltage level on node 25. Output MOS transistor 23 transmits the voltage level on node 25 to output node 24 by the source follower mode operation. Thus the level of output voltage Vo falls. By blowing link elements FA1~FAn, the number of the resistance elements connected in parallel between power supply node 7 and node 42 is reduced and the resistance value between power supply node 7 and node 42 is increased. Accordingly, the effect of the channel resistance of MOS transistor 41 is decreased, thereby pulling down the voltage level on node 42. The fall of the voltage level on node 42 causes the rise of the voltage level on node 25, thereby raising output voltage Vo.

Thus, also in the structure shown in FIG. 8, the voltage level of output voltage Vo can be raised by blowing the appropriate number of link elements FA1~FAn to increase the resistance value of trimmable resistance element 46. When the level of output voltage Vo is lower than a predetermined value, output voltage Vo can be pulled up to the predetermined level. In addition, in the structure where resistance elements RA1~RAn are connected in series to parallel-connected link elements FA1~FAn, the same effect can be obtained by blowing the link elements for increasing the resistance value of the trimmable resistance element. In this case, however, the minimum resistance value must be sufficiently higher than the channel resistance of MOS transistor 41 (in order to operate in the source follower mode).

[First Modification]

Figure 9:
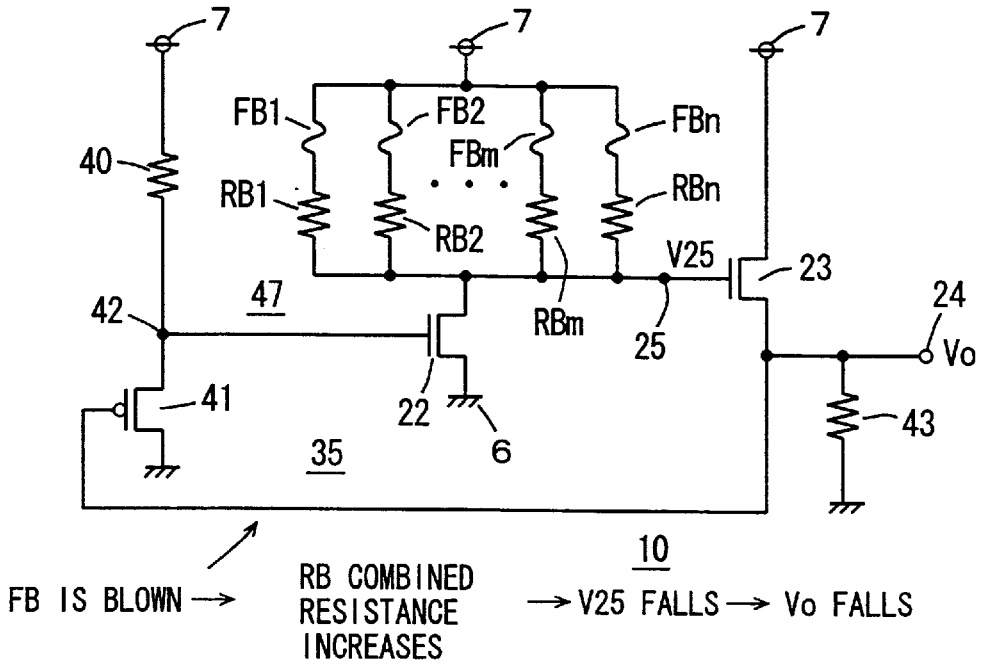
FIG. 9 represents a structure of a first modification of the fourth embodiment of the present invention.

FIG. 9 represents a structure of a first modification of the fourth embodiment of the present invention. An internal power supply circuit 10 shown in FIG. 9 is different from the internal power supply circuit shown in FIG. 5 in the following point. Resistance element 21 shown in FIG. 5 is replaced with a trimmable resistance element 47 having a resistance value thereof trimmable. The structure shown in FIG. 9 is the same with that shown in FIG. 5 in other portions, and corresponding components have the same reference characters allotted.

Trimmable resistance element 47 includes link elements FB1~FBn each having one end connected to power supply node 7 and being programmable to be conductive/non-conductive, and resistance elements RB1~RBn connected in series between link elements FB1~FBn and node 25, respectively. Link elements FB1~FBn are constituted, for example, of fuse elements blowable by an energy ray such as laser.

In the structure shown in FIG. 9, the resistance value between power supply node 7 and node 25 is increased when an appropriate number of link elements FB1~FBn are blown. Accordingly, the effect of the on resistance (parasitic resistance: channel resistance) of MOS transistor 22 is reduced and the voltage level on node 25 drops. Accordingly, the voltage drop on node 25 is transmitted to output node 24 by the source follower mode operation of the MOS transistor 23, whereby output voltage Vo is lowered. When output voltage Vo is lowered, the voltage level on node 42 is also lowered, the on resistance of MOS transistor 22 is increased, thereby raising the voltage level on node 25. The voltage on node 25 is stabilized at the level determined by the channel resistance (on resistance) of MOS transistor 22 and the resistance value of trimmable resistance element 47. The resistance values of resistance elements RB1~RBn are set sufficiently higher than the channel resistance of MOS transistor 22. Therefore, the level of output voltage Vo can be lowered by blowing an appropriate number of link elements FB1~FBn.

[Second Modification]

Figure 10:
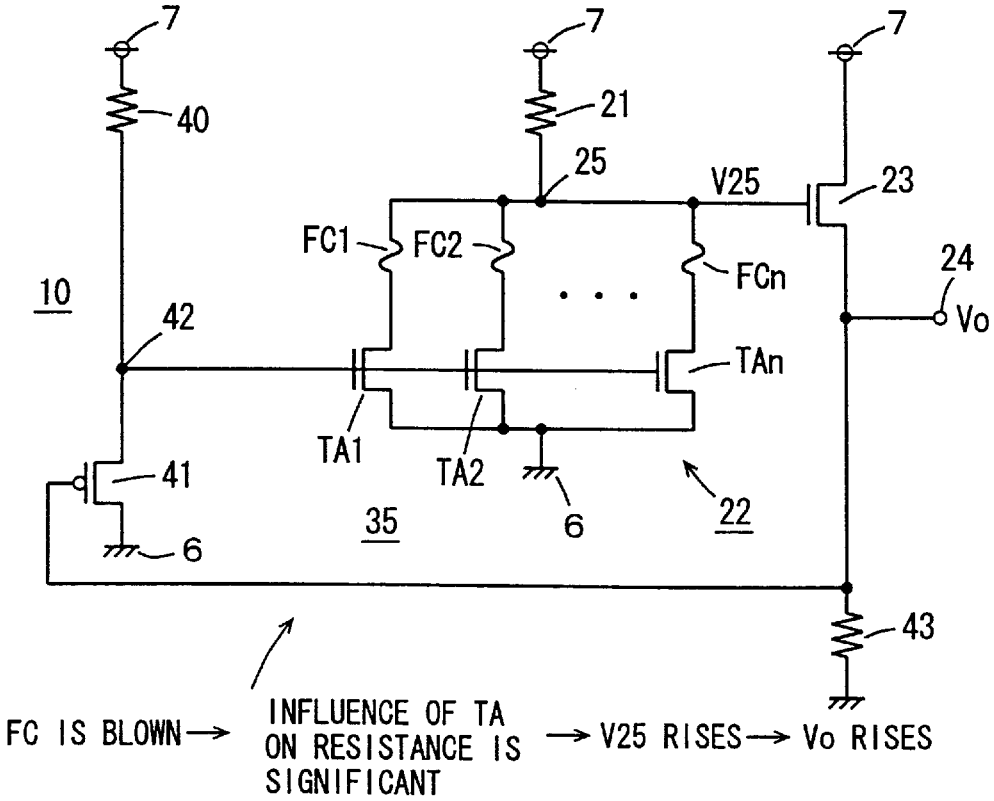
FIG. 10 represents a structure of a second modification of the fourth embodiment of the present invention.

FIG. 10 represents a structure of a second modification of the fourth embodiment of the present invention. An internal power supply circuit 10 shown in FIG. 10 is different from the internal power supply circuit shown in FIG. 5 in the following point. In internal power supply circuit 10 shown in FIG. 10, biasing MOS transistor 22 setting the gate potential of output MOS transistor 23 is replaced with a plurality of MOS transistors TA1~TAn connected in parallel and link elements FC1~FCn connected respectively between MOS transistors TA1~TAn and node 25. Link elements FC1~FCn are each constituted of a fuse element blowable by laser or the like. Gates of MOS transistors TA1~TAn are commonly connected with node 42.

In the structure of internal power supply circuit 10 shown in FIG. 10, when all link elements FC1~FCn are in a conductive state, MOS transistors TA1~TAn are connected in parallel between node 25 and ground node 6 with sufficiently high current drivability and a low combined on-resistance (channel resistance), and therefore the voltage V25 on node 25 takes the minimum value. When an appropriate number of link elements FC1~FCn are blown, corresponding MOS transistors are isolated from node 25, whereby the number of MOS transistors connected in parallel between node 25 and ground node 26 is reduced. Accordingly, the combined on resistance of MOS transistors increases, raising the level of voltage V25 on node 25 and accordingly the level of output voltage Vo from output node 24. Therefore, also in the structure of internal power supply circuit 10 shown in FIG. 10, the level of output voltage Vo can be raised by blowing an appropriate number of link elements FC1~FCn. Even when the threshold voltages of MOS transistors 41 and 23 deviate from the design value, the level of output voltage Vo can be set at a desired level.

In addition, with the use of combination of the internal power supply circuits shown in FIGS. 8 and 9, and combination of the internal power supply circuits shown in FIGS. 9 and 10, the level of output voltage Vo can be adjusted upward and downward.

As can be seen from the foregoing, according to the fourth embodiment of the present invention, the output voltage can be obtained correctly at a desired level regardless of the variation in the threshold voltage because the level of the output voltage is trimmable.

[Fifth Embodiment]

Figure 11:
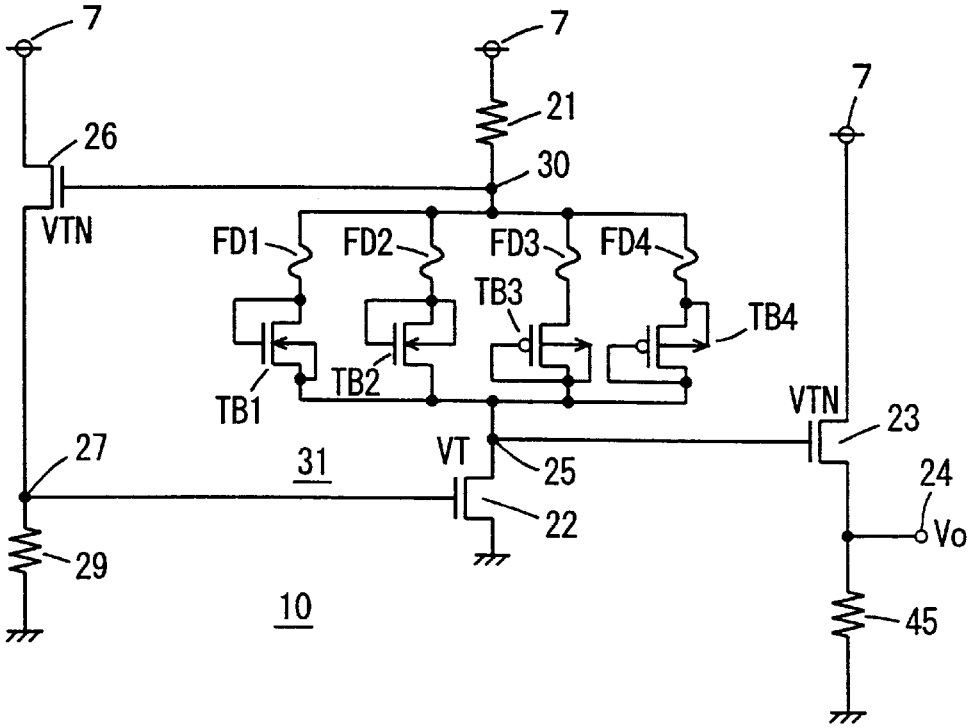
FIG. 11 represents a structure of an internal power supply circuit according to a fifth embodiment of the present invention.

FIG. 11 represents a structure of an internal power supply circuit according to a fifth embodiment of the present invention. In FIG. 11, an internal power supply circuit 10 includes MOS transistors TB1~TB4 arranged in parallel and link elements FD1~FD4 respectively connected in series with MOS transistors TB1~TB4, in place of MOS transistor 28 shifting down the voltage on node 30 for transmission to node 25. The structure is the same with that shown in FIG. 3 in other portions and corresponding components have the same reference numerals allotted.

MOS transistor TB1 is an n channel MOS transistor having a gate and a drain coupled together and a source coupled with a substrate region. MOS transistor TB2 is an n channel MOS transistor having a gate and a backgate coupled with a drain. MOS transistor TB3 is a p channel MOS transistor having a gate and a backgate both coupled with a drain. MOS transistor TB4 is a p channel MOS transistor having a backgate coupled with a source and a gate coupled with a drain.

In a MOS transistor, when a source and a backgate are mutually connected, backgate bias effect will not be caused. In an n channel MOS transistor, the threshold voltage will be further decreased, when the backgate is biased positive with respect to the source. On the other hand, generally in a p channel MOS transistor, when a negative bias relative to the source is applied to the backgate, the absolute value of the threshold voltage is reduced. Therefore, the threshold voltage of MOS transistor TB1 is higher than the threshold voltage of MOS transistor TB2 and the absolute value of the threshold voltage of MOS transistor TB3 is smaller than the absolute value of the threshold voltage of MOS transistor TB4. Hence, even if these MOS transistors TB1~TB4 are fabricated in the same manufacturing process (PMOS transistor and NMOS transistor are manufactured in different processes), the threshold voltages differ from each other depending on the manner of backgate connection. Therefore, by rendering either of MOS transistors TB1~TB4 operative (thereby rendering a corresponding link element conductive), a voltage drop between node 30 and node 25 can be set at an appropriate value and accordingly the level of output voltage Vo can be adjusted. This is because the voltage on node 25 is given by a sum of threshold voltage VT of MOS transistor 22 and threshold voltage VTN26 of MOS transistor 26 minus the absolute value of the threshold voltage of diode-connected MOS transistor TB (either of TB1~TB4).

In addition, even if a backgate and a drain are mutually connected in each of MOS transistors TB2 and TB3, only a voltage drop of about the absolute value of the threshold voltage occurs in these diode-connected MOS transistors TB2 and TB3, and a forward bias is not applied to PN junction between the source and the substrate region. This is because PN junction causes a voltage drop of the magnitude of the absolute value of the threshold voltage. Therefore, in MOS transistor TB2, even if the voltage level on the backgate becomes higher than that on the source, PN junction between the source and the substrate region is maintained in a nonconductive state. Similarly, in MOS transistor TB3, the non-conductive state of PN junction between the source and the substrate region is maintained even when the drain voltage becomes lower than the source voltage by the absolute value of the threshold voltage.

As shown in FIG. 11, the level of the threshold voltage can be changed by switching the connection of backgate, and the level of voltage on node 25 can be set at an optimal value without utilizing a complicated manufacturing process.

[Sixth Embodiment]

Figure 12:
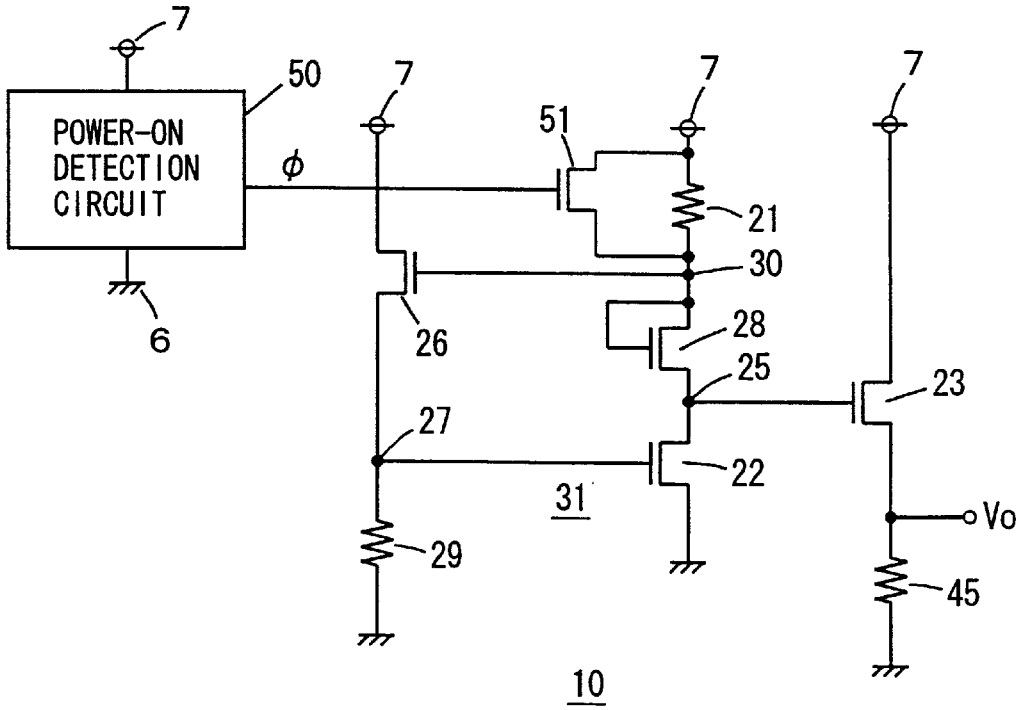
FIG. 12 represents a structure of an internal power supply circuit according to a sixth embodiment of the present invention.
Figure 13:
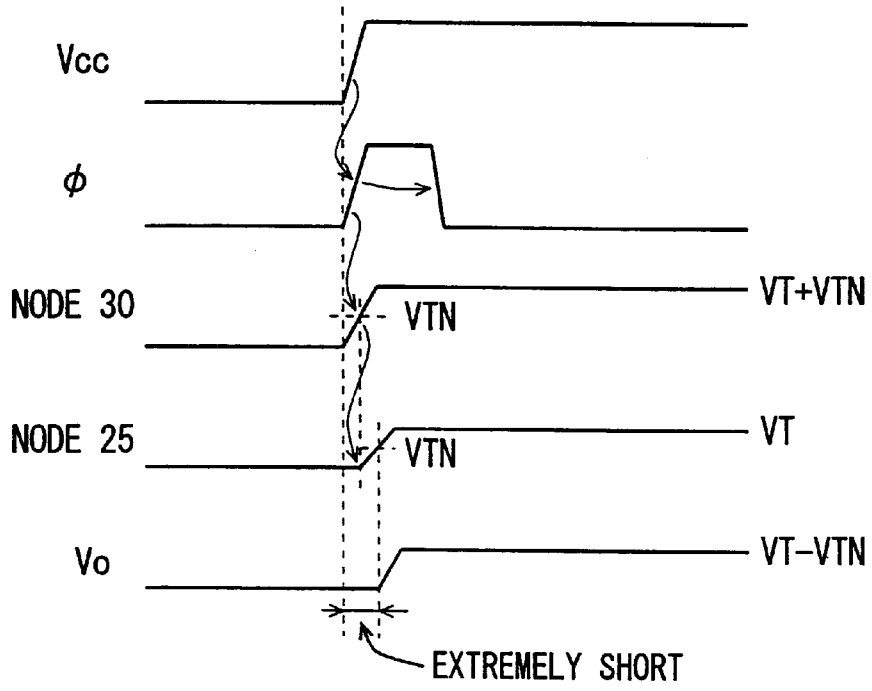
FIG. 13 is a signal waveform diagram representing an operation of the circuit shown in FIG. 12.

FIG. 12 represents a structure of an internal power supply circuit 10 according to a sixth embodiment of the present invention. The internal power supply circuit shown in FIG. 12 is different from the internal power supply circuit shown in FIG. 3 in the following point. In FIG. 12, an n channel MOS transistor 51 having a gate receiving a power-on detection signal $\phi$ from a power-on detection circuit 50 is provided in parallel with high resistance element 21. The structure is the same with the one shown in FIG. 5 in other portions and corresponding components have the same reference characters allotted. Upon starting of application of power supply voltage Vcc on power supply node 7, power-on detection circuit 50 drives power-on detection signal $\phi$ to an active state of an H level for a predetermined period. When MOS transistor 51 is conductive, resistance element 21 is short-circuited and node 30 is charged at high speed. Now, with reference to the signal waveform diagram shown in FIG. 13, an operation of the internal power supply circuit shown in FIG. 12 will be described.

At power-on, the level of power supply voltage Vcc on power supply node 7 rises and power-on detection signal 4 from power-on detection circuit 50 is turned to an H level for a predetermined period. In response to the activation of power-on detection signal 4, MOS transistor 51 is rendered conductive and node 30 is coupled with power supply node 7. Then node 30 is connected to gate capacitance of MOS transistor 26, and the voltage level on node 30 is pulled up at a speed slower than that of the rise of power supply voltage Vcc shortly after the rise of power supply voltage Vcc, for charging the gate capacitance of MOS transistor 26. When the voltage level on node 30 becomes higher than the level of threshold voltage VTN, MOS transistors 26 and 28 are rendered conductive. Through the turned-on of MOS transistor 26, the voltage on node 27 is pulled up. At the same time, node 25 is charged through MOS transistor 28 and the voltage level on node 25 is pulled up.

Output MOS transistor 23 has a sufficiently large size (W/L) and a large gate capacitance so as to be able to drive a large output load. On power-on, however, as node 25 is charged through MOS transistors 51 and 28, the voltage level on node 25 is pulled up much faster than when it is charged through high resistance element 21. As the resistance value R21 of resistance element 21 can be substantially ignored at the rise of the voltage on node 25 with RC delay of the resistance value R21 of resistance element 21 and gate capacitance C of output MOS transistor 23, the level of the voltage on node 25 is pulled up at fast speed. When the voltage level on node 25 exceeds the level of threshold voltage VTN of output MOS transistor 23, output MOS transistor 23 becomes conductive and the level of output voltage Vo is pulled up.

Therefore, compared with the case where a large gate capacitance of output MOS transistor 23 is charged through high resistance element 21, output voltage Vo can reach a predetermined level at a faster timing and the internal circuit can be set in an operative state at a fast timing after the power-on.

[Modification]

Figure 14:
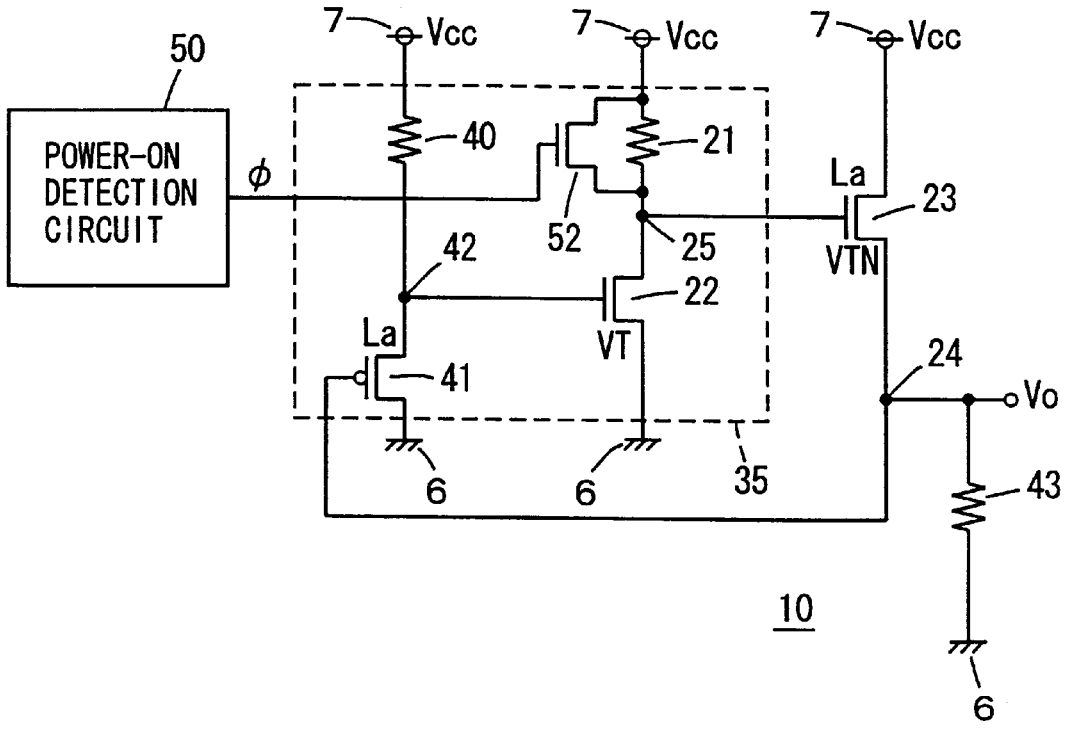
FIG. 14 represents a structure of a modification of the sixth embodiment of the present invention.

FIG. 14 represents a structure of a modification of the sixth embodiment of the present invention. In an internal power supply circuit shown in FIG. 14, an n channel MOS transistor 52 having a gate receiving power-on detection signal $\phi$ from power-on detection circuit 50 is connected in parallel with resistance element 21 in biasing circuit 35 feeding back output voltage Vo. The structure is the same with the one shown in FIG. 5 in other portions and corresponding components have the same reference numerals allotted and detailed description thereof will not be repeated.

In internal power supply circuit 10 shown in FIG. 14, a gate of output MOS transistor 23 having a large gate capacitance is also charged through high resistance element 21. Therefore, the speed of the rise of the voltage on node 25 is slow and output MOS transistor 23 cannot be rendered conductive at a fast timing, and the stabilization of output voltage Vo may be delayed. By connecting node 25 to power supply node 7 through MOS transistor 52 for a predetermined period in power-on, however, the voltage level on internal node 25 can be pulled up at a fast speed and output voltage Vo can be stabilized at a fast timing.

Thus, according to the sixth embodiment of the present invention, as the high resistance element for charging the gate of output MOS transistor is adapted so as to be short-circuited at the time of power-on, the output MOS transistor can be rendered conductive at fast timing to generate output voltage Vo, and output voltage Vo can be stabilized after the poweron at a fast timing after the power-on.

[Seventh Embodiment]

Figure 15:
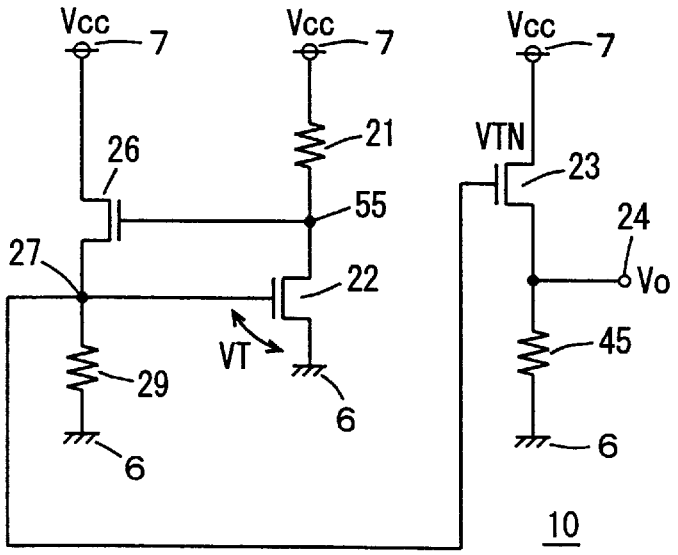
FIG. 15 represents a structure of an internal power supply circuit according to a seventh embodiment of the present invention.

FIG. 15 represents a structure of an internal power supply circuit 10 according to a seventh embodiment of the present invention. In FIG. 15, an internal power supply circuit 10 includes an n channel MOS transistor 26 connected between power supply node 7 and node 27 and having a gate connected to node 55, a high resistance element 21 connected between power supply node 7 and node 55, an n channel MOS transistor 22 connected between node 55 and ground node 6 and having a gate connected to node 27, a high resistance element 29 connected between node 27 and ground node 6, and an output MOS transistor 23 supplying current from power supply node 7 to output node 24. A pulling down high resistance element 45 is connected to output node 24.

In the structure of internal power supply circuit 10 shown in FIG. 15, a diode-connected pulling down MOS transistor is not employed for shifting down the gate voltage of MOS transistor 26 for transmission to the gate of output MOS transistor 23. Instead, the gate of output MOS transistor 23 is connected to node 27.

MOS transistors 26 and 22 and high resistance elements 21 and 29 constitute a constant-current circuit and a constant voltage is generated on node 27. When the voltage level on node 55 rises, conductance of MOS transistor 26 increases and the amount of current supplied from power supply node 7 to node 27 increases, thereby raising the voltage level on node 27. According to the rise of the voltage on node 27, conductance of MOS transistor 22 increases, lowering the voltage level on node 55 and decreasing the conductance of MOS transistor 26. Conversely, when the voltage level on node 55 falls, conductance of MOS transistor 26 decreases, thereby reducing the amount of current flowing to resistance element 29 and lowering the voltage level on node 27. Correspondingly, the conductance of MOS transistor 22 decreases and the driving current amount of MOS transistor 22 is reduced, raising the voltage level on node 55. Thus, the conductance of MOS transistor 26 is again increased.

Nodes 27 and 55 are always maintained at a fixed voltage level by a feedback loop of MOS transistors 22 and 26. Resistance elements 21 and 29 have the resistance values sufficiently higher than the on resistance (channel resistance) of MOS transistors 22 and 26. As only a minute current flows through MOS transistors 22 and 26, the voltage level on node 27 is maintained at the level of threshold voltage VT of MOS transistor 22. Thus, also in the internal power supply circuit shown in FIG. 15, the level of output voltage Vo is at a level of VT-VTN. Therefore, the temperature dependency and dependency on the variations of threshold voltage of output voltage Vo are cancelled. In addition, by setting the gate length of MOS transistor 26 substantially equal to the gate length of MOS transistor 23, dependency of output voltage Vo on power supply voltage can be cancelled. At the rise of the power supply voltage Vcc, if the driving current increases because of the short channel effect of MOS transistor 26, the voltage level on node 27 is raised. Accordingly, the conductance of MOS transistor 22 increases, thereby lowering the voltage level of node 55, reducing the conductance of MOS transistor 26, and lowering the level of the voltage on node 27. Responsively, the gate voltage of output MOS transistor 23 is reduced and the rise of output voltage Vo at the time of rise of power supply voltage Vcc is suppressed.

Output MOS transistor 23 is driven by the voltage on node 27. The voltage on node 27 is supplied via MOS transistor 26. MOS transistor 26 is driven by resistance element 21. The size (ratio W/L of channel width to channel length) of MOS transistor 26 is set at a small value such as about one tenth or one hundredth times the size of output MOS transistor 23. Therefore, compared with the structure where the gate of output MOS transistor 23 is charged via high resistance element 21, faster charge of the gate capacitance of MOS transistor 26 and faster rise of the voltage on node 55 are allowed, whereby the voltage level on node 27 can be driven to a predetermined level at a faster timing through operation of the feedback loop. Therefore, output voltage Vo can be stabilized after the power-on at a faster timing.

As can be seen from the foregoing, according to the seventh embodiment of the present invention, as the output MOS transistor is charged via the source follower MOS transistor having the gate capacitance charged through the high resistance element, charge of the output MOS transistor through the high resistance element is not required, and whereby the fast rise of output voltage Vo is allowed.

[Eighth Embodiment]

Figure 16:
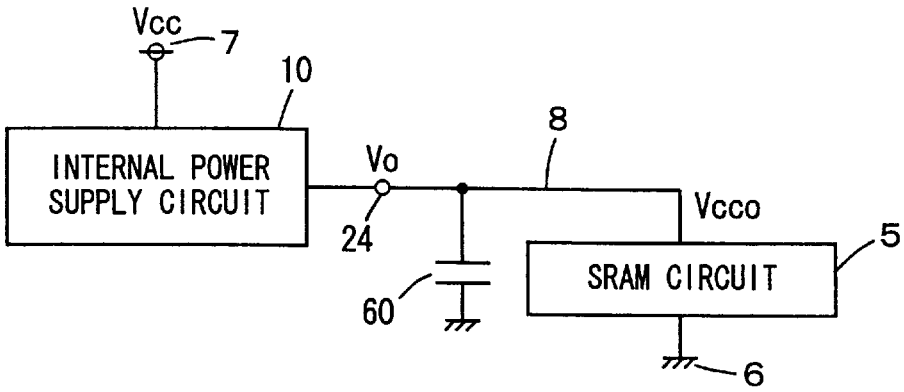
FIGS. 16–18 represent schematic structures of internal power supply circuits according to eighth, ninth and tenth embodiments of the present invention, respectively.

FIG. 16 represents a structure of an internal power supply circuit 10 according to an eighth embodiment of the present invention. In FIG. 16, a stabilizing capacitance 60 is connected to internal power supply line 8 transmitting output voltage Vo from internal power supply circuit 10 to an SRAM circuit 5 as operating power supply voltage Vcco. Stabilizing capacitance 60 is provided in proximity of output node 24. Internal power supply circuit 10 may have one of the structures of first to seventh embodiments described above.

When SRAM circuit 5 operates fast, a large current abruptly flows through internal power supply line 8. Current is supplied to internal power supply line 8 via output MOS transistor 23 included in internal power supply circuit 10. If load current flowing to internal power supply line 8 is larger than the current supplied through output MOS transistor 23, the level of output voltage Vo abruptly drops and the stable operation of SRAM circuit 5 is not allowed. Therefore, the large load current flowing through internal power supply line 8 is supplied using electric charges accumulated in stabilizing capacitance 60. Thus, the sharp fall of the level of output voltage Vo can be compensated for, and the level of operating power supply voltage Vcco can be stably maintained at a fixed level. The capacitance value of stabilizing capacitance 60 is set at an appropriate value depending on the load capacitance of SRAM circuit 5 and the amount of current flowing and consumed during the fast operation.

As can be seen from the above description, according to the eighth embodiment of the present invention, as the stabilizing capacitance is connected to the output node of internal power supply circuit 10, even if a large current is abruptly consumed at the fast operation of SRAM circuit, the current consumption can be compensated for by the stabilizing capacitance, thereby allowing the suppression of fall of the output voltage of the internal power supply circuit and therefore the fall of the level of the operating power supply voltage of the SRAM circuit.

[Ninth Embodiment]

Figure 17:
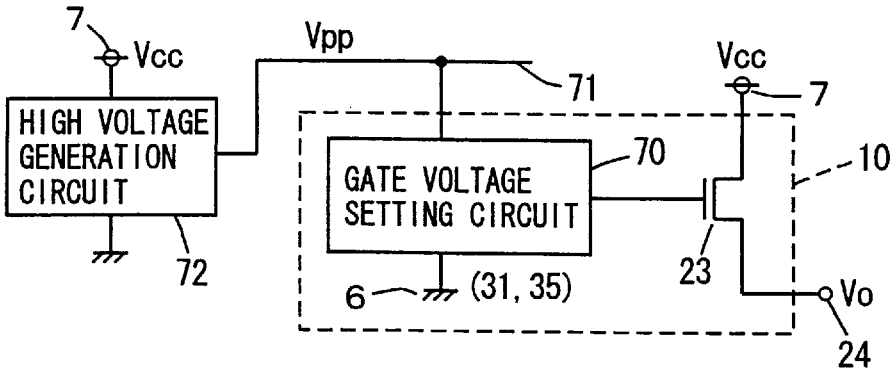

FIG. 17 represents a structure of an internal power supply circuit 10 according to a ninth embodiment of the present invention. In FIG. 17, an internal power supply circuit 10 includes a gate voltage setting circuit 70 generating voltage at a predetermined level from a high voltage Vpp on a high power supply voltage line 71 and an output MOS transistor 23 receiving the output voltage of gate voltage setting circuit 70 at its gate and supplying current to output node 24. Gate voltage setting circuit 70 may have any structure of the first to seventh embodiments described above and can be negative feedback circuit 31 or biasing circuit 35.

High voltage Vpp on high power supply voltage line 71 is generated by high voltage generation circuit 72 receiving an external power supply voltage Vcc applied to power supply node 7 as one operating power supply voltage. High voltage generation circuit 72 generates high voltage Vpp at a higher level than external power supply voltage Vcc through the charge pumping action, for example.

As gate voltage setting circuit 70 includes an MOS transistor, the voltage applied to the operating power supply node must be at least at the level of VT+VTN in order to operate the MOS transistor properly. Therefore, when the level of external power supply voltage Vcc is low, gate voltage setting circuit 70 may be incapable of stable operation. Stable generation of output voltage Vo at a desired level is allowed even in low power supply voltage environment by setting the gate voltage of output MOS transistor 23 using high voltage Vpp instead of external power supply voltage Vcc.

As can be seen from the foregoing, according to the ninth embodiment of the present invention, as high voltage Vpp at a higher level than the external power supply voltage is supplied as one operating power supply voltage to the circuit for setting the gate voltage of the output MOS transistor, the generation of output voltage Vo at a desired level is allowed even in the environment where power supply voltage is low.

[Tenth Embodiment]

Figure 18:
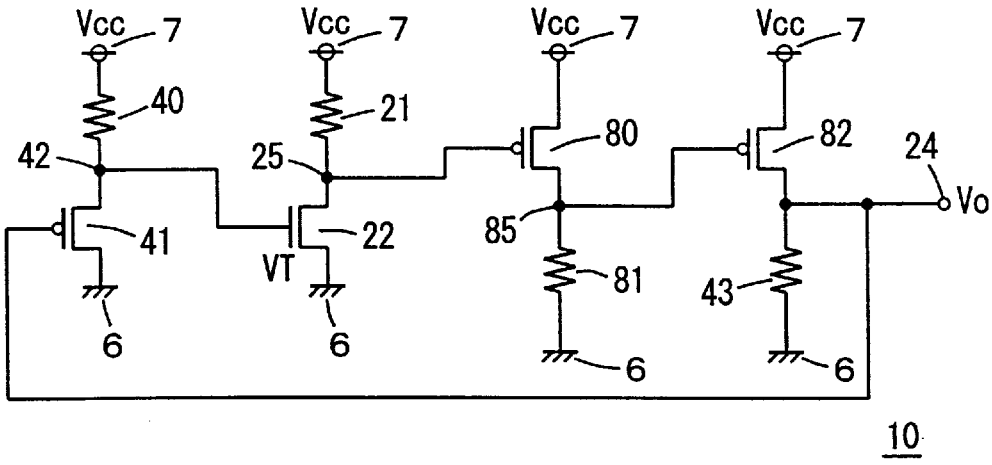

FIG. 18 represents a structure of an internal power supply circuit 10 according to a tenth embodiment of the present invention. In an internal power supply circuit 10 shown in FIG. 18, dissimilar to the structure shown in FIG. 5, the output driving stage includes two cascaded p channel MOS transistors 80 and 82. Similar to the structure shown in FIG. 5, the bias setting circuit for setting the gate potential of the output MOS transistor includes a p channel MOS transistor 41 receiving output voltage Vo from output node 24 at its gate, a high resistance element 40 supplying current to p channel MOS transistor 41, an n channel MOS transistor 22 receiving voltage on node 42 at its gate and a high resistance element 21 supplying current to n channel MOS transistor 22.

The output driving stage includes a p channel MOS transistor 80 connected between power supply node 7 and a node 85 and receiving the voltage on node 25 at its gate, a high resistance element 81 connected between node 85 and ground node 6, and a p channel MOS transistor 82 connected between power supply node 7 and output node 24 and receiving the voltage on node 85 at its gate. A pull down resistance element 43 is connected to output node 24.

Similar to the structure shown in FIG. 5, MOS transistor 41 operates in the source follower mode and the voltage level on node 42 is represented by Vo +|VTP41 |, where VTP41 indicates the threshold voltage of MOS transistor 41. When output voltage Vo is increased, the voltage level on node 42 is raised responsively, increasing the conductance of MOS transistor 22 and pulling down the voltage level on node 25. When the voltage level on node 25 is lowered, the conductance of MOS transistor 80 increases and the voltage level on node 85 rises. Responsive to the raised voltage on node 85, the conductance of MOS transistor 82 is reduced to decrease the current supply to output node 24 to lower the level of output voltage Vo.

On the other hand, when output voltage Vo is lowered, the voltage level on node 42 falls accordingly, to reduce the conductance of MOS transistor 22 to raise the voltage level on node 25. With the rise of the voltage on node 25, the conductance of MOS transistor 80 is reduced and the voltage level on node 85 is lowered. With the fall of the voltage on node 85, the conductance and current drivability of MOS transistor 82 is increased, and the current supplied to output node 20 from power supply node 7 is increased. Thus, the level of output voltage Vo is raised.

Thus, similar to the structure shown in FIG. 5, output voltage Vo is stabilized at a predetermined level by the negative feedback loop. As resistance element 21 has a high resistance, only a minute current flows through MOS transistor 22. Therefore, in the stable state, the level of the voltage on node 42 is substantially equal to the level of the threshold voltage VT of MOS transistor 22. Hence, output voltage Vo is represented by the following equation.

$$Vo=VT-|VTP41|$$

For driving the output, p channel MOS transistor 82 is used. Output MOS transistor 82 supplies current from power supply node 7 to output node 24 according to the gate voltage. Dissimilar to the n channel MOS transistor, output MOS transistor 82 does not operate in the source follower mode and the current supplying capability thereof is set according to the difference between the voltage on node 85 and voltage Vcc on power supply node 7. Therefore, compared with the case where an n channel MOS transistor operating in the source follower mode is employed, a sufficiently large current supplying capability of output MOS transistor 82 is allowed, and correspondingly, downsizing of output MOS transistor 82 can be realized. When a p channel MOS transistor is utilized as the output transistor, the absolute value of the gate-source voltage can be set higher than gate-source voltage of the output n channel MOS transistor operating in the source follower mode.

[Modification]

Figure 19:
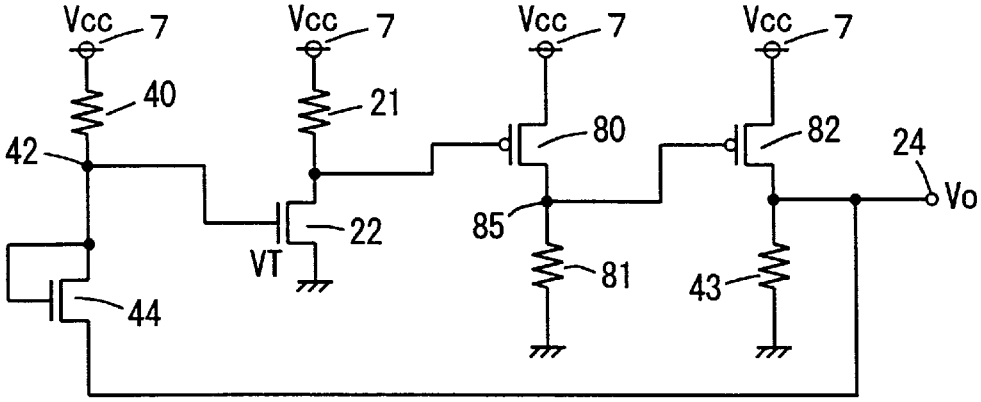
FIG. 19 represents a modification of the tenth embodiment of the present invention.

FIG. 19 represents a modification of the tenth embodiment of the present invention. In FIG. 19, an n channel MOS transistor 44 is arranged instead of p channel MOS transistor 41 shown in FIG. 18. The structure is the same with the one shown in FIG. 18 in other portions and corresponding components have the same reference numerals allotted. MOS transistor 44 has a gate and a drain connected to node 42 and a source connected to output node 24. Therefore, output voltage Vo can be represented as VT-VTN44, where VTN44 indicates the threshold voltage of MOS transistor 44.

The circuit structure shown in FIG. 19 operates in the same manner as the circuit shown in FIG. 18 except that MOS transistor 44 operates in the diode mode. As the p channel MOS transistor is employed as the output driving transistor in the output stage, an MOS transistor with large current drivability can be realized in a small area.

As can be seen from the foregoing, according to the tenth embodiment of the present invention, as the p channel MOS transistor is used as an output driving transistor in the output stage, an internal power supply circuit with a large current drivability can be realized in a small area.

[Another Application]

Figure 20:
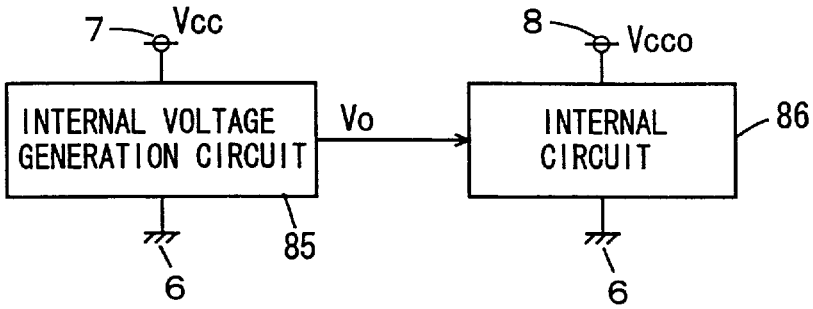
FIG. 20 represents another application of the present invention.
Figure 21:
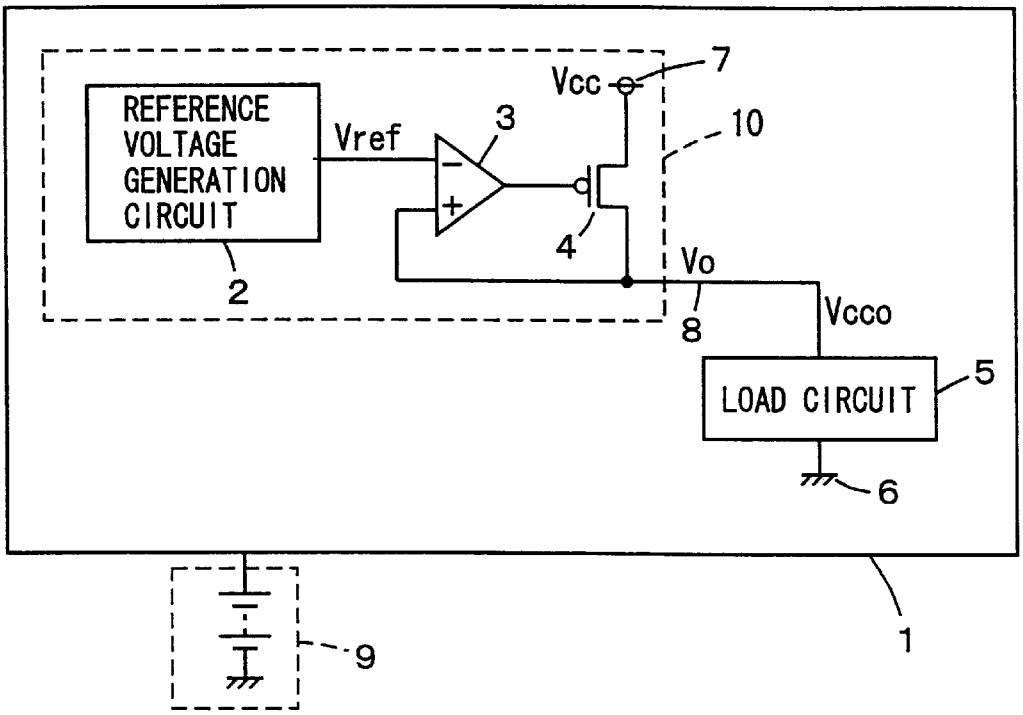
FIG. 21 PRIOR ART
FIG. 21 represents a structure of a conventional internal power supply circuit.
Figure 22:
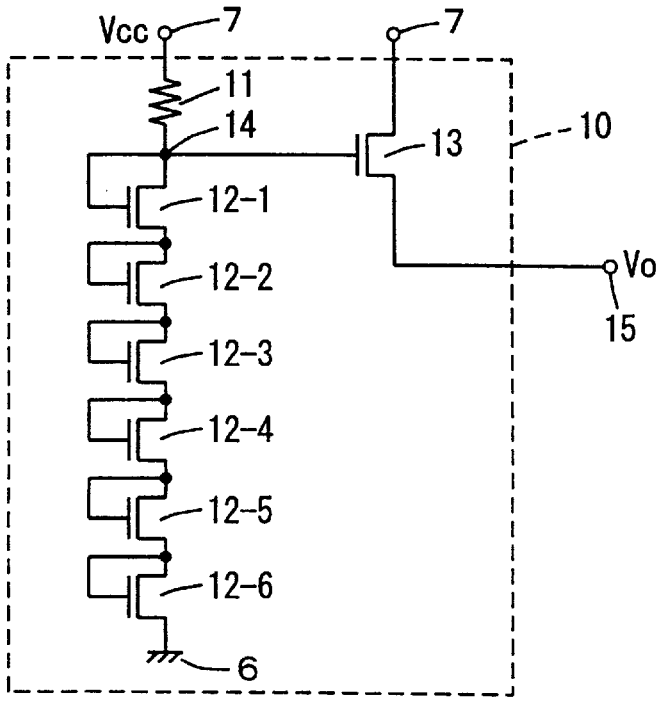
FIG. 22 PRIOR ART
FIG. 22 represents another structure of a conventional internal power supply circuit.

FIG. 20 shows another application of the present invention. In FIG. 20, an internal voltage generation circuit 85 supplies output voltage Vo to an internal circuit 86. Internal circuit 86 receives operating power supply voltage Vcco on an internal power supply line 8 as one operating power supply voltage. The structure of internal voltage generation circuit 85 can be one of the first to tenth embodiments described above. Output voltage Vo may be employed as a reference voltage in internal circuit 86. As the level of output voltage Vo is represented as VT-VTN (when an n channel MOS transistor is used), the output voltage at a desired level can be obtained through adjustment of the threshold voltage. Therefore, output voltage Vo can be used as a reference voltage for comparison in internal circuit 86. In addition, output voltage Vo supplied from internal voltage generation circuit 85 can be used as a gate voltage for driving a constant-current source transistor.

In the above description, in order to satisfy the condition of power consumption in the standby state required for the SRAM, the power consumption is set approximately to 1 μA. The internal power supply circuit of the present invention, however, can be used as a power supply circuit for other types of semiconductor integrated circuit devices in which low power consumption is required. In addition, the present invention is applicable in memories other than SRAM, such as EEPROMs (electrically erasable and programmable read only memories) including flash memories that permit a data block or blocks to be erased at a time and dynamic random access memories (DRAMs).

As can be seen from the foregoing, according to the present invention, as the circuit is configured to generate an output voltage represented by the difference of threshold voltages, stable generation of the output voltage at a desired level is allowed without being influenced by the variations in threshold voltage and temperature dependency.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal voltage generation circuit comprising:

an output transistor connected between a power supply node and an output node and having a first threshold voltage, for transmitting to said output node a voltage of a magnitude corresponding to a difference between said first threshold voltage and a voltage applied to a gate thereof;

a biasing transistor coupled with the gate of said output transistor and having a second threshold voltage greater in absolute value than said first threshold voltage, for setting the gate of said output transistor at a level of said second threshold voltage; and a feedback circuit coupled with said biasing transistor and said output transistor, for changing gate voltages of said biasing transistor and said output transistor in opposite directions in response to change in voltage on said power supply node.

2. The internal voltage generation circuit according to claim 1, wherein said feedback circuit includes:

a resistance element coupled between said power supply node and a first internal node;

a voltage drop element for dropping a voltage on said first internal node by a predetermined value for transmission to the gate of said output transistor; and a source follower transistor for down-converting the voltage on said first internal node through a source follower operation for transmission to the gate of said biasing transistor.

3. An internal voltage generation circuit comprising:

an output transistor connected between a power supply node and an output node and having a first threshold voltage, for transmitting to said output node a voltage of a magnitude corresponding to a difference between said first threshold voltage and a voltage on a gate thereof;

a biasing transistor for setting the voltage on the gate of said output transistor; and a level shift transistor for shifting an output voltage of said output transistor by a predetermined value for transmission to a gate of said biasing transistor.

4. The internal voltage generation circuit according to claim 1, wherein said biasing transistor includes a plurality of trimming elements connected in parallel to each other, each of said plurality of trimming elements including a program element being programmable to be conductive or non-conductive and a trimming transistor connected in series with said program element.

5. The internal voltage generation circuit according to claim 2, wherein said voltage drop element includes a plurality of trimming transistors connected in parallel to each other and having different threshold values from each other.

6. The internal voltage generation circuit according to claim 5, wherein said plurality of trimming transistors include an insulated gate field effect transistor having a backgate and a drain connected together and an insulated gate field effect transistor having a backgate and a source connected together.

7. The internal voltage generation circuit according to claim 2, further comprising a switching transistor for short-circuiting said resistance element in response to power-on.

8. The internal voltage generation circuit according to claim 1, wherein said feedback circuit includes, a resistance element coupled between a first power source node and said biasing transistor through a first node, and an adjusting circuit responsive to a voltage on said first node for adjusting the voltage on a gate of said biasing transistor, said biasing transistor has the gate connected to the gate of said output transistor.

9. The internal voltage generation circuit according to claim 2, wherein said biasing transistor has a drain connected to the gate of said output transistor.

10. The internal voltage generation circuit according to claim 3 further comprising a plurality of trimming elements connected in parallel with each other between said level shift transistor and a constant-voltage node receiving a constant voltage, wherein said plurality of trimming elements each include a program element being programmable to be conductive or non-conductive and a resistance element connected in series with said program element.

11. The internal voltage generation circuit according to claim 3 further comprising a plurality of trimming elements connected in parallel with each other between said biasing transistor and a constant-voltage node supplying a constant voltage, wherein said plurality of trimming elements each include a program element being programmable to be conductive or non-conductive and a resistance element connected in series with said program element.

12. The internal voltage generation circuit according to claim 3, wherein said biasing transistor includes a plurality of trimming elements connected in parallel with each other, said plurality of trimming elements each including a program element being programmable to be conductive or non-conductive and an insulated gate field effect transistor connected in series with said program element.

13. The internal voltage generation circuit according to claim 3, wherein said output transistor is a P channel insulated gate field effect transistor.

14. The internal voltage generation circuit according to claim 13, wherein said level shift transistor includes a P channel insulated gate field effect transistor receiving the output voltage of said output transistor at a gate thereof.

15. The internal voltage generation circuit according to claim 13, wherein said level shift transistor includes a diode-connected insulated gate field effect transistor connected between said biasing transistor and said output node.

16. The internal voltage generation circuit according to claim 13, further comprising an amplifying transistor coupled between said biasing transistor and said output transistor, for supplying current according to a drain voltage of said biasing transistor from a constant voltage node supplying a constant voltage, to set the voltage on the gate of said output transistor.

17. The internal voltage generation circuit according to claim 3, wherein said level shift transistor includes a diode-connected insulated gate field effect transistor.

18. The internal voltage generation circuit according to claim 2, wherein said source follower transistor and said output transistor comprises field effect transistors and are substantially equal in channel length.

19. The internal voltage generation circuit according to claim 3, wherein said level shift transistor and said output transistor comprises field effect transistors and are substantially equal in channel length.

20. An internal voltage generation circuit comprising:

an output transistor for generating an output voltage according to a voltage received on a gate thereof;

a biasing transistor for setting the gate voltage of said output transistor in response to a voltage on a gate thereof; and a negative feedback loop coupled with said output transistor and biasing transistor for adjusting the gate voltage of said biasing transistor so as to suppress variation in gate voltage of said output transistor through a negative feedback operation on the output voltage wherein said biasing transistor operates in a source follower mode to transfer the gate voltage received from the negative feedback loop to the gate of the output transistor.

* * * * *